US006755349B2

(12) United States Patent
Beidokhti

(10) Patent No.: US 6,755,349 B2
(45) Date of Patent: Jun. 29, 2004

(54) BATTERY-POWERED REMOTELY CONTROLLED FLOATING POOL FOUNTAIN AND LIGHT DEVICE

(76) Inventor: Noorolah Nader Beidokhti, 16757 Maple St., Fountain Valley, CA (US) 92708

( * ) Notice: Subject to any disclaimer, the term of this patent is extended or adjusted under 35 U.S.C. 154(b) by 220 days.

(21) Appl. No.: 10/124,935

(22) Filed: Apr. 18, 2002

(65) Prior Publication Data

US 2002/0179728 A1 Dec. 5, 2002

Related U.S. Application Data

(63) Continuation-in-part of application No. 09/654,544, filed on Sep. 1, 2000, now Pat. No. 6,375,090.

(51) Int. Cl.[7] ..... B05B 17/08

(52) U.S. Cl. ..... 239/17; 239/16; 239/18; 239/20; 239/23

(58) Field of Search ..... 239/16, 17, 28, 239/22, 23, 99, DIG. 15

(56) References Cited

U.S. PATENT DOCUMENTS 2,745,697 A * 5/1956 Pearse ..... 239/20
4,088,880 A * 5/1978 Walsh ..... 362/96
4,920,465 A * 4/1990 Sargent ..... 362/96
5,918,809 A * 7/1999 Simmons ..... 239/17
6,375,090 B1 * 4/2002 Beidokhti ..... 239/17
6,427,927 B1 * 8/2002 Hall ..... 239/17

* cited by examiner

*Primary Examiner*—Robin O. Evans
(74) *Attorney, Agent, or Firm*—Roy A. Ekstrand

(57) ABSTRACT

A housing defines a sealed interior cavity to provide buoyancy for floating the housing in water. A rechargeable battery maintains the vertical alignment of the buoyant housing. The buoyant housing supports a plurality of upwardly directed lights and fountain nozzles together with a plurality of manually accountable switches. An internal pump mechanism draws water into the buoyant housing and forces it upwardly through the fountain nozzles to produce vertically directed fountain sprays. The fountain sprays may be illuminated by the light assemblies. A remote control receiver and control circuit within the buoyant housing receives operative control signals from a handheld remote control unit. A remotely controlled rotation valve is operatively coupled to the pump output and provides a laterally directed water spray component tending to rotate the entire fountain unit. A tether and anchor fix the unit position within a swimming pool. An ultra sound mechanism automatically spaces the unit from the pool edges. A remotely controlled boat unit may be used to move the unit.

26 Claims, 23 Drawing Sheets

59
58
49
48
30
16
11
12
14
15
2
52
51
25
54
32
35
22
24
21
33
34
69
50
23
66
68
64
67
65
61
87
60
62
63
85
40
10
20
75
2
41
43
13
44

FIG. 3
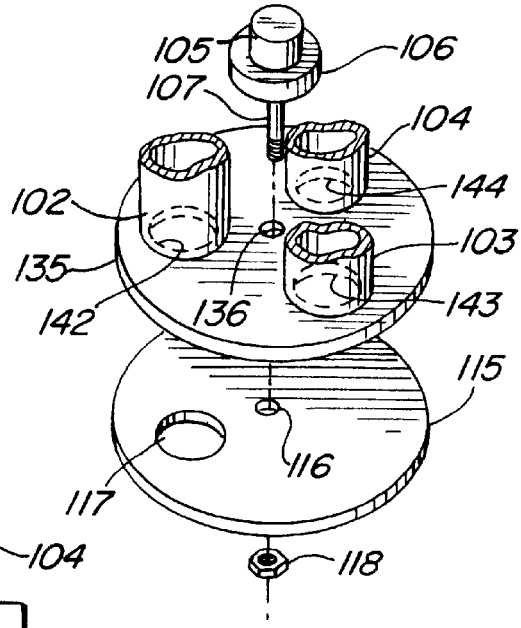
FIG. 4
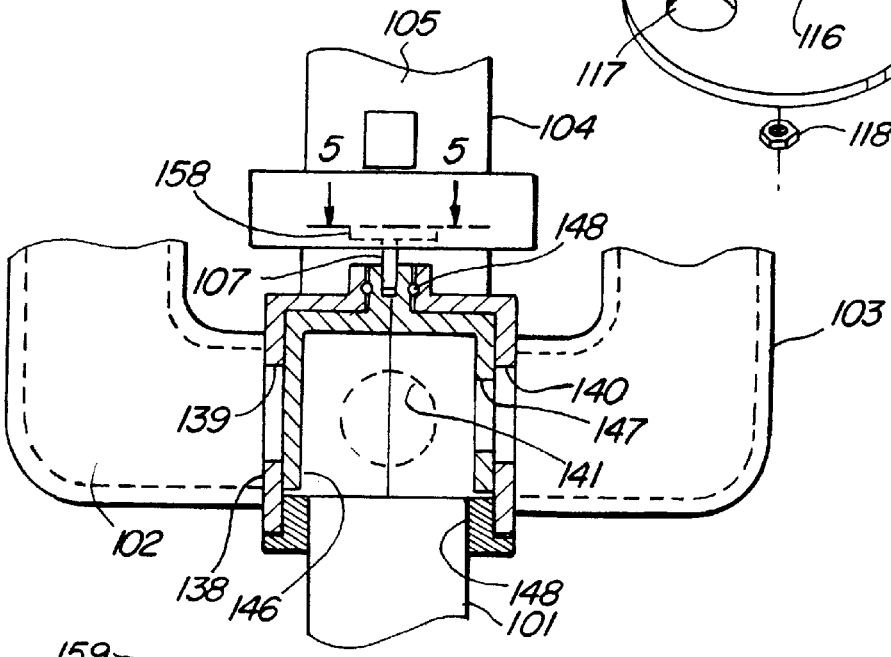
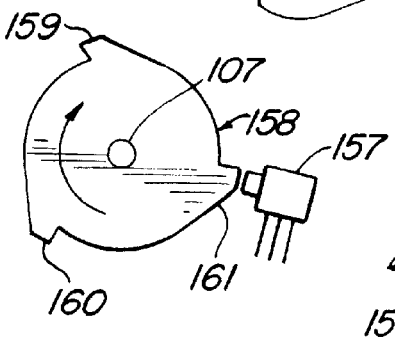
FIG. 5
FIG. 8
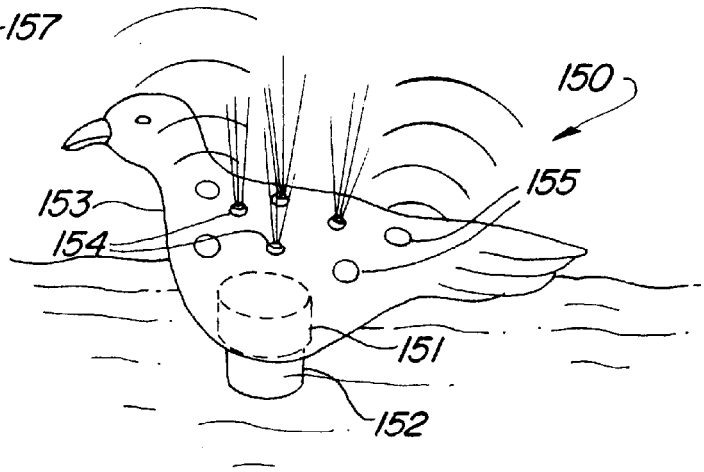

BATTERY-POWERED REMOTELY CONTROLLED FLOATING POOL FOUNTAIN AND LIGHT DEVICE

CROSS REFERENCE TO RELATED PATENT APPLICATION

This application is a continuation-in-part of application Ser. No. 09/654,544 filed Sep. 1, 2000 now U.S. Pat. No. 6,375,090 in the name of the applicant of the present application entitled BATTERY-POWERED REMOTELY CONTROLLED FLOATING POOL FOUNTAIN AND LIGHT DEVICE which is incorporated herein by reference.

FIELD OF THE INVENTION

This invention relates generally to apparatus for use in connection with pools and particularly to apparatus which provides aesthetic enhancement of pools using fountains and decorative lights. While the present invention apparatus may be used in virtually any pool, it is particularly advantageous and particularly directed toward use in swimming pools.

BACKGROUND OF THE INVENTION

Swimming pools provide substantial relaxation and enjoyment as well as healthful exercise and activity. In addition, swimming pools also provides aesthetic enhancement of their environments. This is particularly true of swimming pools used in residential situations such as single family homes and apartment or condominium complexes. In many instances, homeowner's in the process of landscaping and planning their backyards and patio areas virtually center the decoration and landscaping about the swimming pool. In response to the consumer sensitivity to the aesthetic qualities of swimming pools, practitioner's in the pool arts have brought forth various attractive features to enhance the appeal of their respective swimming pool products. These features have included attractive shapes of the pools themselves as well as attractive cooperating patio and sidewalk materials. In addition, practitioners have provided various decorative lights and water flow features such as water falls or the like in designing and constructing swimming pools. In some instances these water fall features have been further enhanced by fountain apparatus. In a typical swimming pool fountain apparatus, one or more fountain nozzles are supported in the pool area or within the pool itself and are coupled to the high pressure side of the water filtration and circulation pump system.

Despite the attractiveness of fountains and other features in swimming pools, the relatively high-cost and need for installation during pool construction has greatly limited the number of swimming pools having such apparatus.

In response to the continuing need and desire on the part of swimming pool owners for aseptic features such as fountains or the like, practitioner's in the pool arts have provided a variety of swimming pool fountain devices which are capable of installation in swimming pools after construction. Typically, these swimming pool fountain devices utilize a floating unit supporting a plurality of lights and fountain nozzles. The floating unit is further coupled to the high pressure portion of the pool filter pump system. For example, U.S. Pat. No. 4,088,880 issued to Walsh sets forth a DECORATIVE FOUNTAIN especially adapted for use in a swimming pool. The fountain is adapted to float at the surface of the pool and incorporates a sealed beam light bulb for illumination of the fountain display. A self contained source of electric current for the light bulb is also supported within the floating unit. The fountain portion is coupled to the high pressure portion of the swimming pool filter pump system by a flexible hose.

U.S. Pat. No. 4,416,420 issued to Tompson sets forth a PORTABLE FOUNTAIN FOR POOLS OR SPAS having a pedestal supporting an upright tube within the pedestal which in turn supports an upwardly directed nozzle. The lower end of the tube is coupled to a flexible hose which in turn in coupled to the high pressure side of the swimming pool filter system.

U.S. Pat. No. 4,305,117 issued to Evans sets forth an ARTIFICIAL ILLUMINATION OF ORNAMENTAL WATER FOUNTAINS WITH COLOR BLENDING IN RESPONSE TO MUSICAL TONE VARIATIONS in which three sets of lamps in different colors are independently controlled during the playing of the musical number. The response of the lamps produces a multitude of different colors reflected by the fountain in response to the amplitude and frequency of the musical tones.

U.S. Pat. No. 4,920,465 issued to Sargent sets forth a FLOATING FOUNTAIN DEVICE for use in a swimming pool having a fountainhead to create a water fountain and a lamp and generator to illuminate the fountain. The generator is sealed within an envelope and driven by a water turbine through a magnetic coupling.

U.S. Pat. No. 5,718,379 issued to Cramer sets forth a LOW PROFILE FOUNTAIN having a submersible motor and pump secured to a frame to provide a relatively low profile. The pump motor is supported at the front end of the frame and extends generally horizontally. The pump is secured to the frame in front of the motor and includes an impeller mounted in a first pump chamber to draw water into the pump chamber and direct water upwardly through a plurality of fountain heads.

U.S. Pat. No. 5,040,726 issued to Dimitri sets forth a SOLAR ENERGY POWERED WATER FOUNTAIN having a submersible pump within a water filled container and a solar panel. The solar panel is removably connected in an electrical circuit relationship with the pump for controlling pump operation. The amount of water discharged from the pump and the display patterns produced by the pump are directly responsive to variations in light level at the solar panel.

U.S. Pat. No. 4,936,506 issued to Ryan sets forth a SWIMMING POOL FOUNTAIN configured for installation within a swimming pool, spa, hot tub or the like. The fountain is secured to high pressure side of the filtration system and may include discharge apparatus having shapes such as animals or the like.

U.S. Pat. No. 3,889,880 issued to Rhuby, Jr. sets forth a FLOATING FOUNTAIN having a submerged vertical support coupled to the high pressure side of the pool filter system pump at its lowered end and supporting a generally oval water flow conduit at its upper end. A fountain nozzle is supported upon the upper end of the fluid conduit together with a pair of floats and a plurality of upwardly directed lights.

U.S. Pat. No. 3,814,317 issued to Rhuby, Jr. sets forth ILLUMINATED WATER FOUNTAINS having a submerged support base further supporting an upwardly directed fountain nozzle. The base also supports a plurality of upwardly directed lights.

While the foregoing described prior art devices have to some extent improved the art and in some instances enjoyed commercial success, they remain subject to substantial limitations in their attractiveness of use. Most particularly, there need to couple to the high pressure side of the swimming pool filter system and in some instances, electrical connection to external electrical power sources places undesired hoses and/or wires upon the pool bottom surfaces. With the prevalent use of cleaning apparatus such as automated pool cleaners, these coupling hoses and/or electrical wires become extremely undesirable. In essence, the pool owner is not able to operate a conventional automated pool cleaner without removing the fountain device and its coupling structure. In most houses having a swimming pool, the filtration pump is located a short distance from the pool. Thus, the pump sound can be heard around the pool area. This makes the existing fountains which use the pump for water flow undesirable. There remains therefore a need in the art for evermore improved and effective pool fountain apparatus.

SUMMARY OF THE INVENTION

Accordingly, it is a general object of the present invention to provide an improved pool fountain apparatus. It is a more particular object of the present invention to provide an improved pool fountain apparatus which accommodates the use of automated pool cleaners. It a still more particular object of the present invention to provide an improved pool fountain apparatus which avoid the need for coupling to the filtration system and/or sources of electrical power through the use of coupling hoses and electrical wires.

In accordance with the present invention there is provided for use in a pool of water, a floating pool fountain and light device comprising: a buoyant housing having an upper surface and interior cavity; a plurality of fountain nozzles directed generally upwardly; a plurality of light-sources projecting generally upwardly; a first battery-powered pump producing a first water flow coupled to the fountain nozzles for producing a generally upwardly directed spray; a remote control unit producing control signals; a second battery-powered pump producing a second water flow; a rotation jet coupled to the second battery-powered pump producing a thrust tending to rotate the floating fountain and light device; and a controller supported by the housing receiving the control signals and selectively receiving the control signals and selectively activating the first battery-powered pump, the second battery-powered pump and the light sources in response to the control signals. From an alternate perspective, the present invention provides for use in a pool of water, a floating pool fountain and light device comprising: a buoyant housing having an upper surface and interior cavity; at least one generally upwardly directed battery-powered fountain producing fountain spray; at least one light source directed to illuminate the fountain spray; and an automatic spacing mechanism having a plurality of directional water jets directed generally outwardly from the housing, a plurality of sensors for sensing proximity of the pool fountain and light device to a pool edge or object, and a plurality of water jet actuators each responsive to one of the sensors, the sensors, the actuators and the water jets cooperating to automatically maintain a distance between the floating pool fountain and light device and a pool edge or object.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 3 sets forth a partial section perspective assembly view of the fountain control of the apparatus of the present invention pool fountain;

FIG. 4 sets forth a partial section view of an alternate embodiment of the water flow control portion of the present invention;

FIG. 5 sets forth a section view of the alternate embodiment of FIG. 4 taken along section lines 4—4 therein;

FIG. 8 sets forth an alternate embodiment of the present invention pool fountain configured to resemble an animal;

DESCRIPTION OF THE PREFERRED EMBODIMENT

Figure 1:
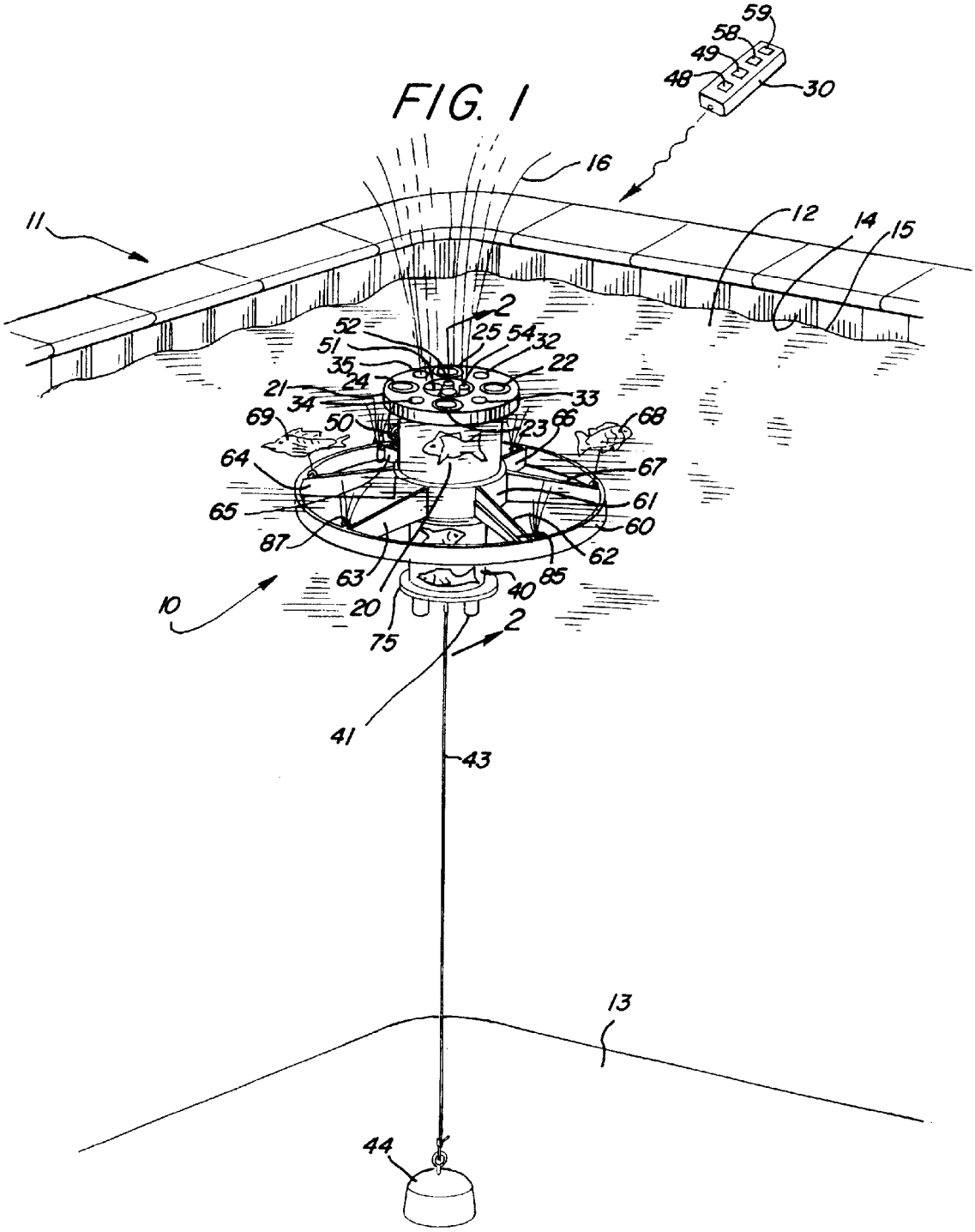
FIG. 1 sets forth a perspective view of a battery-powered remotely controlled pool fountain apparatus constructed in accordance with the present invention situated in a typical pool environment.

FIG. 1 sets forth a battery-powered remotely controlled floating pool fountain and light device constructed in accordance with the present invention and generally referenced by numeral 10. Pool fountain 10 is found received within a conventional swimming pool generally referenced by numeral 11. Pool 11 is fabricated in accordance with conventional fabrication techniques and includes a vertical pool wall 14 and a bottom surface 13. In further accordance with conventional fabrication techniques, pool 11 supports a quantity of water 12 defining a water surface 15.

In accordance with the present invention, fountain 10 includes a floating unit having a generally cylindrical housing 20 supporting a battery housing 40 and an upper plate 21. Upper plate 21 supports a plurality of upwardly directed light assemblies 22, 23, 24 and 25 together with a plurality of depressible switch assemblies 32, 33, 34 and 35. In addition, upper plate 21 supports a trio of upwardly directed fountain nozzles 51, 52 and 53. A vent valve 54 is further supported upon upper plate 21. Housing 20 further supports a rotation valve 50 operative in the manner set forth below to provide axle rotation of fountain 10 when desired.

Battery housing 40 includes a lower plate 75 supporting a plurality of downwardly extending rest elements 41. In addition, by means better seen in FIG. 2, lower plate 75 includes an attachment 42 which secures the upper end of a flexible tether 43. The lower end of tether 43 is secured to an anchor 44 which rests upon bottom surface 13.

In the configuration shown in FIG. 1, fountain 10 is shown supporting an optional spacer ring 60 which is securable to housing 20 by a cylindrical collar 61. Collar 61 is joined to spacer ring 60 by a plurality of radially extending spokes 62, 63, 64, 65, 66 and 67. To enhance the aesthetic appeal of fountain 10, a plurality of simulated fish-shaped objects 68 and 69 are secured to spacer ring 60 by flexible cords. In their preferred fabrication, simulated fish 68 and 69 are extremely decorative and colorful and exhibit a positive buoyancy causing them to freely float about their respective attachments to spacer ring 60. The housing of fountain 10 can be made with decorative photo-luminescent paint or materials to glow at night.

In further accordance with the present invention, fountain 10 includes a remote control 30 operative in accordance with conventional fabrication techniques to communicate radiated signals which, by means set forth below in greater detail, are received by fountain 10 to control the operation thereof.

In operation, and by means set forth below in greater detail, fountain 10 is operative to produce a selected plurality of upwardly directed water sprays forming fountain sprays 16 in response to actuation of any one of switches 32 through 35 or in response to actuation of remote control 30. In addition, and by means also set forth below in greater detail, fountain 10 responds to remote control 30 to activate one or more of light assemblies 22 through 25 to produce upwardly directed light beams which illuminate fountain spray 16. In the preferred fabrication of the present invention, light assemblies 22 through 25 support color tinted lens such as lens 27 shown in FIG. 2. As a result, the color of illumination of fountain spray 16 may be altered by selective activation of one or more of light assemblies 22 through 25. As mentioned, fountain 10 is free floating within water 12 and if desired, fountain 10 can be maintained at a general position by tether 43 and anchor 44. Battery housing 40 supports a battery power supply (seen in FIG. 2) for providing operative power to an internal pump (pump 90 shown in FIG. 2) to produce upwardly directed fountain sprays 16. In addition, battery housing 40 and the internal battery 70 (seen in FIG. 2) therein provides the desired weight distribution for fountain 10 which ensures that fountain 10 floats in the upright position shown. Toward this end, housing 20 defines an interior cavity 26 (seen in FIG. 2) which produces the desired flotation buoyancy for fountain 10.

In operation, fountain 10 freely floats with water 12 of swimming pool 11 and is maintained in general location by tether 43 and anchor 44. As fountain 10 floats within pool 11, the user is able to activate and control the operation of fountain 10 entirely through the use of remote control 30. Thus, remote control 30 allows the user to operate fountain 10 without requiring any direct contact therewith. This is particularly desirable when, and if, fountain 10 is positioned a substantial distance from the outer walls of pool 11.

By way of further variation of operation, tether 43 and anchor 44 may be disconnected from fountain 10 and removed leaving fountain 10 in a free floating configuration. When tether 43 and anchor are not in use, fountain 10 is able to gently float about with pool 11 providing a further enhancement of fountain operation. In addition, the removal of tether 43 and anchor 44 allows the automatic pool cleaning apparatus (not shown) within pool 11 to remain operative and prevents any interference with pool cleaner operation by fountain 10. As mentioned above, spacer ring 60 supported upon housing 20 by collar 61 is an optional accessory for the use of fountain 10. In a tethered configuration such as shown in FIG. 1, the need for spacer ring 60 is minimized. However, with a freely floating use of fountain 10, such as occurs when tether 43 and anchor 44 are removed from fountain 10, the use of spacer ring 60 becomes highly desirable. In essence, spacer ring 60 ensures that fountain 10 does not come to close to any of the exterior pool walls such as pool wall 14 during its freely floating operation. The extension of spokes 62 through 67 and the outer positioning of ring 60 cause spacer ring 60 to contact the pool wall as fountain 10 approaches it and thereby maintain a minimum distance between fountain 10 and the pool wall. This has been found particularly advantageous in situations in which the user desires to avoid transferring water which is upwardly sprayed in fountain spray 16 onto the surrounding walkways and patio surfaces which are generally adjacent pool 11.

In accordance with a further variation of the operation of fountain 10, and by means set forth below in greater detail, fountain 10 when operating in freely floating configuration may be caused to rotation by opening rotation valve 50. As is described below, the opening of rotation valve 50 allows a small portion of the pressurized water being pumped upwardly to form spray 16 to be directed laterally on one side of fountain 10 causing a slow rotation of the fountain unit.

Thus, the present invention battery-powered remotely controlled floating pool fountain and light device is capable of complete remote controlled operation and is freely floating and independent. Accordingly, interference with pool cleaning equipment such as automatic cleaners is avoided. In the preferred fabrication of the present invention, the internal battery supply within fountain 10 may be replaced or recharged by simply removing the entire fountain unit from the pool and securing a conventional battery charger (not shown) thereto. The fountain unit of the present invention may also be controlled manually by actuation of any one of a plurality of switches 32 through 35 supported upon upper plate 21 of the fountain unit. By means set forth below in greater detail, the particular type of fountains spray produced by fountain 10 may be adjusted by selection of one of the plurality of upwardly directed fountain nozzles supported upon the unit. The operation of this fountain spray selection is set forth below in FIGS. 2 and 3 in greater detail. However, suffice it to note here, that a simple selection valve mechanism is operative within housing 20 to direct water under pressure through any one of the selected fountain nozzles.

By means set forth below in FIG. 2 in greater detail, the upwardly directed fountain spray of fountain 10 may be adjusted in spray elevation or spray height by operation of a manually controlled spray adjustment valve (valve 55 shown in FIG. 2). A ballast weight 84 is supported within housing 20 to balance the unit in an upright position. The shape, weight and location of ballast 84 may be varied for different units as needed.

Figure 2:
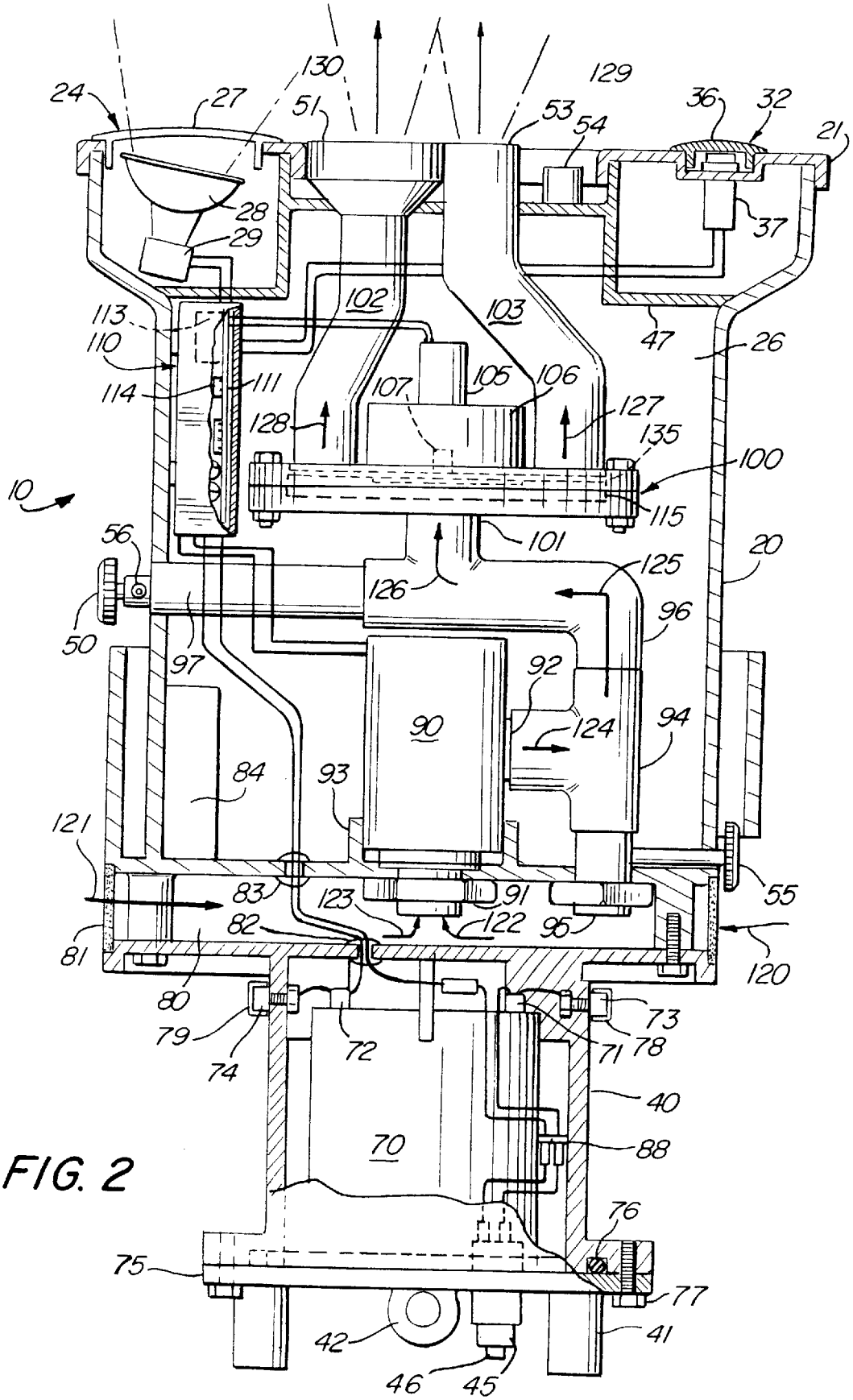
FIG. 2 sets forth a section view of the pool fountain apparatus of FIG. 1 taken along section lines 2—2 therein.

FIG. 2 sets forth a section view of fountain 10 taken along section lines 2—2 in FIG. 1. As described above, fountain 10 includes a generally cylindrical housing 20 supporting an upper plate 21 and coupled to a battery housing 40. Battery housing 40 includes a lower plate 75 supporting a plurality of downwardly extending rest members 41 and a master switch 45 having an actuator 46. Lower plate 75 also supports an attachment 42 utilized in securing tether 43 to anchor 44 in the manner shown in FIG. 1. Master switch 45 is a normally closed switch which operates as a safety switch to ensure that the unit is inoperable when rested upon legs 41 and is operative when the unit is floating. When removing lower plate 75 to replace battery 70, connector 88 attached to housing 40 disconnects battery power. Connector 88 will be reconnected when lower plate 75 is reinstalled.

Housing 20 further defines an interior cavity 26 which in accordance with the preferred fabrication of the present invention, is sealed to form a water tight buoyant structure for housing 20. Conversely, battery housing 40 supports a rechargeable battery 70 having a pair of battery terminals 71 and 72. Battery housing 40 further supports a pair of battery connectors 73 and 74 operatively coupled to battery terminals 71 and 72 respectively. Connectors 73 and 74 provide access to battery 70 for purposes of recharging. Battery connectors 73 and 74 in turn support seal cap 78 and 79 respectively. Caps 78 and 79 prevent electrical contact between battery connectors 73 and 74 and the surrounding water in order to prevent battery discharge through the water.

Housing 20 further defines an intake chamber 80 positioned beneath housing 20 having an annular filter 81 supported thereon. Filter 81 is preferably formed of a porous filter material suitable for preventing waterborne particles and objects from being drawn into intake chamber 80 in the operation of fountain 10 described below. Intake chamber 80 further includes a pair of resilient seals 82 and 83 which maintain the water tight character of intake chamber 80. A seal 76 is supported by lower plate 75 of battery housing 40 and cooperates with fasteners 77 to maintain the water tight seal of battery housing 40 to prevent water damage to battery 70.

Fountain 10 further includes a support 93 formed on the lower end of housing 20 having a motor and pump combination 90 supported thereon. Motor and pump combination 90 is fabricated in accordance with conventional fabrication techniques to provide an electrically driven pump capable of drawing water from intake chamber 80. Accordingly, motor and pump 80 includes an intake 91 extending downwardly into intake chamber 80. Motor and pump combination 90 further includes an output 92 coupled to a tee fitting 94. Fitting 94 has one side coupled to a downwardly extending return which passes into intake chamber 80 and a remaining side joined to a coupler 96. A spray height adjustment valve 55 is supported within return 95 and is fabricated in accordance with conventional fabrication techniques. Coupler 96 includes an upwardly extending housing input 101 and a laterally extending portion forming a coupler 97. Coupler 97 receives a rotation valve 50 which includes a laterally disposed discharge port 56.

Input 101 of coupler 96 is joined to a spray housing 100. Spray housing 100 is generally cylindrical in shape and is formed by a pair of plates secured by conventional fasteners. Within spray housing 100, a rotating plate 115 and a tube plate 135 are supported. By means set forth below in greater detail, rotating plate 115 is rotatable supported within spray housing 100 by a shaft 107. A gear drive unit 106 is secured to the upper side of spray housing 100 by conventional attachment (not shown) and includes shaft 107 as an outward shaft. Suffice it to note here, that shaft 107 passes through to plate 135 and is secured to rotating plate 115 by a conventional fastener. A motor 105 is secured upon and operatively coupled to gear unit 106 such that energizing of motor 105 produces a corresponding rotation of shaft 107. The rotation of shaft 107 in turn causes rotation of rotating plate 115. The operation of plates 135 and 115 together with drive gear unit 106 is described below in FIG. 3 in greater detail. Suffice it to note here, that each time motor 105 is energized, rotating plate 115 is caused to rotate at a reduced speed through the action of drive gear unit 106.

Spray housing 100 further includes a plurality of upwardly extending nozzle tubes 102, 103 and 104 (tube 104 seen in FIG. 3). Nozzle tubes 102, 103 and 104 terminate in upwardly extending spray nozzles supported by support bracket 47 which in turn is supported by housing 20. For example, nozzle tube 102 terminates in a broadly directed spray nozzle 51 while nozzle tube 103 terminates in a more narrowly dispersed fountain nozzle 53. As is better seen in FIG. 1, nozzle tube 104 terminates in a spray nozzle 53.

Fountain 10 further includes a vent valve 54 constructed in accordance with conventional fabrication techniques, and configured to maintain a normally open condition so long as vent valve 54 is not placed beneath water. In the event water reaches the upper portion of vent valve 54, the valve closes to avoid the introduction of water into interior cavity 26 of housing 20.

As is seen in FIG. 1, upper plate 21 supports a plurality of switch units 32, 33, 34 and 35. As is also seen in FIG. 1, upper plate 21 supports a plurality of light assemblies 22, 23, 24 and 25. Returning to FIG. 2, switch unit 32 is shown in section view and will be understood to be identical to switch units 33, 34 and 35. Thus, the descriptions set forth herein of switch unit 32 will be understood to be equally explicable to switch units 33, 34 and 35. Similarly, FIG. 2 shows a section view of light assembly 24. However, it will be understood that light assembly 24 is substantially identical to light assemblies 22, 23 and 25 shown in FIG. 1. Accordingly, the descriptions set forth below in connection with light assembly 24 will be understood to apply equally well and be equally descriptive of light assemblies 22, 23 and 25 shown in FIG. 1.

Switch unit 32 maintains a resilient seal 36 providing closure of upper plate 21 and preventing water from entering into the interior of switch unit 32. A push button switch 37 is fabricated in accordance with conventional fabrication techniques, and is positioned beneath seal 36. Accordingly, a downward force applied to seal 36 will deform seal 36 and allow switch 37 to be actuated.

Light assembly 24 includes a lens 27, which in the preferred fabrication of the present invention, is tinted to a desired color. Lens 27 provides a liquid tight seal of light assembly 24. Light assembly 24 further includes a socket 29 supported by conventional support means (not shown) and having a light bulb 28 supported therein. Bulb 28 may be fabricated entirely in accordance with conventional fabrication techniques and preferably includes a some what focused or "flood-like" type bulb.

A control circuit 100 having a printed circuit 111 fabricated in accordance with conventional fabrication techniques is supported within interior cavity 26. Control circuit 100 is shown in schematic detail in FIG. 6 and includes a conventional remote control integrated circuit 114 and a motor control integrated circuit 112. Additional components are supported upon printed circuit board 111. In further accordance with conventional fabrication techniques, an antenna 113 is supported upon printed circuit 111 and is operatively coupled to remote control circuit 114.

Control circuit 110 may be fabricated in accordance with conventional fabrication techniques and is operatively coupled to motor 105, motor and pump unit 90, battery 70, switch units 32 through 35 and light assemblies 22 through 25 by conventional connecting wires. Control circuit 110 provides response to remote control unit 30 (seen in FIG. 1) as signals transmitted by remote control unit 30 are received by antenna 113. The operative circuitry for remote control unit 114 may be entirely conventional in fabrication and may utilize virtually any remote control unit and remote control receiver combination to provide the communication of a set of control signals to which control circuit 110 may respond. While a variety of remote control command sets and combinations may be used in the present invention fountain without departing from the spirit and scope of the present invention, it has be found advantageous to provide the following functions: a pump on/off function, a light on/off, a fountainhead selection, and a light selection. In response to each of these commands received by antenna 113 from remote control 30, or by manual activation using switches 32, 33, 34 and 35 (seen in FIG. 1), control circuit operates light assemblies 22 through 25 and motor and pump unit 90 as well as motor 105.

More specifically, each time control circuit 110 receives an pump on or pump off signal from remote control 30, motor and pump 90 is changed between on and off states. Motor 105 is energized by the pump on/off switch to periodically switch the water flow through spray housing 100 producing a repeated sequence of fountain spray changes between nozzles 51, 52 and 53 (seen in FIG. 1). Each time control circuit 110 receives a fountainhead selection signal either from remote control 30 or switches 32 through 35, the changing of spray nozzles stops at the then current fountain spray. The repeated spray change is resumed when the next fountainhead control signal is received.

The operation of spray housing 100, motor 105 and drive gear unit 106 is set forth below in greater detail. Suffice it to note here, that upon power up motor 105 is actuated and the water flow is sequentially and continuously switched between fountain nozzles 51, 52 and 53. When a fountainhead selection signal is received, the flow remains at the current fountainhead. In a similar manner, lights 22 through 25 are sequentially energized until a light on/off signal is received from remote control 30. At that point, the currently active one of light assemblies 22 through 25 remains on. When the next light selection signal is received, the sequential activation of light assemblies 22 through 25 is restored.

In the preferred embodiment of the present invention, the rate of sequential changes of lights 22 through 25 is different from the rate of change between fountainhead nozzles 51 through 53. This allows different color illuminations of each fountain over time to improve the beauty of lighted fountain sprays.

In operation, the energizing of motor and pump 90 causes water to be drawn inwardly in the directions indicated by arrows 120 and 121 through filter 81 into intake chamber 80. Thereafter, water flows upwardly in the directions indicated by arrows 122 and 123 through intake 91. Water thereafter is forced outwardly through output 92 in the direction indicated by arrow 124 under substantially increased pressure. The water flow in forced upwardly through coupler 96 as indicated by arrows 125 and 126 into spray housing 100. Thereafter, the water flow continues upwardly through the selected one of nozzle tubes 102 through 104 as indicated by arrows 127 and 128. This upwardly directed water is forced through the corresponding one of fountain nozzles 51, 52 or 53 (nozzle 52 seen in FIG. 1) in the directions indicated by arrows 129 and 130.

In addition, the user may open rotation valve 50 to provide a supplemental water flow component outwardly through discharge port 56. The horizontal orientation of discharge port 56 causes a correspondingly horizontal jet of water to exit port 56. This in turn, imparts a rotational force to fountain 10 causing the entire fountain unit to slowly rotate. The degree or speed of rotation in controlled by adjustment of valve 50.

Adjustment valve 55 is positioned within return coupling 95. In its normally closed position, valve 55 prevents water flow downwardly from tee 94 and causes the entire output of motor and pump 90 to be directed upwardly to produce upwardly directed water sprays such as sprays 129 or 130. However, the height of fountain spray produced may be reduced by opening spray adjustment valve 55. As valve 55 is opened, a portion of the water flow output of motor and pump 90 is returned through return coupling 95 into intake chamber 80. The proportionate part of returned water flow and reduction of upwardly directed flow in controlled by adjusting valve 55. As a result, the height of fountain spray produced by fountain 10 may be controlled.

It will be apparent to those skilled in the art that the physical arrangement of components within the pool fountain are, to some extent, a matter of design choice. The overall objective of component location is directed toward maintaining upright orientation and buoyancy. Thus, different numbers of fountainheads, lights, batteries or battery sizes as well as pump 90 and other components may be used without departing from the spirit and scope of the present invention.

The present invention, can e fabricated in various models having different options. For example, a simple unit having one fountainhead and one light and an on/off switch with remote control may be provided. Alternatively, the unit may include other fountainheads, lights and accessories.

FIG. 3 sets forth a perspective assembly view of the interior components within spray housing 100 which cooperate to provide selective water flow through either fountain nozzle 51, 52 or 53 (nozzles 51 through 53 seen in FIG. 1). A tube plate 135 is secured within spray housing 100 by conventional attachment (not shown) and defines a plurality of apertures 142, 143 and 144. Apertures 142, 143 and 144 are coupled to upwardly extending nozzle tubes 102, 103 and 104 respectively. As described above, nozzle tubes 102, 103 and 104 are in turn coupled to fountain nozzles 51, 53 and 52 respectively.

A gear drive unit 106 is coupled to a motor 105 and includes an output shaft 107. As described above, shaft 107 is rotated at a selected speed through the action of gear drive unit 106 each time motor 105 is activated. Stationary tube plate 135 defines an aperture 136 through which shaft 107 extends. Rotating plate 115 defines an aperture 116 which receives the lower end of shaft 107. A conventional fastener 118 secures the lower end of shaft 107 to rotating plate 115. Rotating plate 115 further defines an aperture 117.

In addition, and with return to FIG. 1, a water tube 85, coupled to pump 90, provides a pressurized flow of water to a plurality of nozzles 87 through a passage (not shown)

formed in a ring 86 of spacer ring 60. This provides further fountain action. Preferably, spacer ring 60 is moved upwardly upon housing 20 when this feature is used.

In operation, rotating plate 115 and tube plate 135 are positioned against each other within spray housing 100 (seen in FIG. 2). Shaft 107 passes loosely through aperture 136 and is secured to rotating plate 115 through aperture 116 and fastener 118. The rotational position of plate 115 with respect to apertures 142, 143 and 144 of tube plate 135 controls the flow of water upwardly through aperture 117 and a selected one of nozzle tubes 102, 103 and 104. If for example, motor 105 rotates plate 115 such that aperture 117 is aligned with aperture 142 of tube plate 135, water flow will pass upwardly through nozzle tube 102 and produce a fountain spray directed upwardly from fountain nozzle 51. Conversely, the rotation of plate 115 to an alignment with aperture 143 causes water flow to pass upwardly through nozzle tube 103 and produce an upwardly directed fountain spray from fountain nozzle 53 (seen in FIG. 2). Similarly, rotation of plate 115 to align aperture 117 with aperture 144 causes upwardly directed water flow through nozzle tube 104 thereby producing a fountain spray upwardly directed from fountain nozzle 53 (seen in FIG. 1). In this manner, the cooperation of rotating plate 115 and stationary tube plate 135 in response to motor 105 and gear drive unit 106 provides selection between alternative fountain nozzles and different spray patterns.

FIG. 4 sets forth a partial section view of a water flow control mechanism constructed in accordance with an alternate embodiment of the present invention. With temporary return to FIG. 2, it will be understood that the water flow control mechanism shown in FIG. 4 replaces the operative structure of spray housing 100, rotating plate 115 and stationary plate 135. It will be further understood that nozzle tubes 102, 103 and 104 are shaped somewhat differently but perform the identical function of communicating water flow to fountain nozzles 51, 52 and 53 (seen in FIG. 1).

Returning to FIG. 4, water flow input 101 is coupled to an end plug 145 having a passage 148 formed therein. A generally cylindrical closed end cap housing 138 is secured to end plug 145 in a water tight attachment. Housing 138 is joined to nozzle tubes 102, 103 and 104. Correspondingly, housing 138 defines water flow apertures 139, 140 and 141 respectively, each aligned with a corresponding one of nozzle tubes 102, 103 and 104. A generally cylindrical closed end rotor 146 is rotatably supported within the interior of housing 138 and defines a water flow aperture 147. Gear drive housing 106 and motor 105 are supported above housing 138 by conventional support means (not shown) which may, for example, include fixed attachment to housing 138. The upper end of rotor 146 is coupled to the lower end of shaft 107 extending downwardly from gear unit 106. The engagement of shaft 107 with the upper end of rotor 146 ensures that rotor 146 is rotated when motor 105 is energized. An O-ring seal 148 provides water tight seal between the upper rotatable portion of rotor 146 and housing 138. In addition, gear drive unit 106 supports a cam 158 which is set forth below in FIG. 5 in greater detail. A cam switch 157 is operatively coupled to cam 158 in the manner also set forth below in FIG. 5.

In operation, when motor 105 is energized, gear drive unit 106 provides rotational coupling of motor 105 to shaft 107. Correspondingly, rotation of shaft 107 provides rotation of rotor 146 within housing 138. The rotation of rotor 146 within housing 138 provides movement of water flow aperture 147 between the position shown in FIG. 4 in which aperture 147 is aligned with aperture 140 of nozzle tube 103 and alternative positions in which aperture 147 is sequentially aligned with aperture 139 of nozzle tube 102 and aperture 141 of nozzle tube 104. As a result, water flow is allowed to flow for a period of time through each of nozzle tubes 102, 103 and 104 as rotor 146 is rotated by motor 105, gear drive unit 106 and shaft 107.

FIG. 5 sets forth a partial section view of gear drive unit 106 taken along section lines 5—5 in FIG. 4. As described above, a cam 58 is rotatably supported upon a shaft 107. As is also described above, shaft 107 is rotated by gear drive 106 and motor 105 (seen in FIG. 4). Cam 158 defines a plurality of outwardly extending cam lobes 159, 160 and 161. A cam switch 157 is operatively coupled to the motor control circuit shown in FIG. 6. Suffice it to note here, that actuation of cam switch 157 by any one of cam lobes 159, 160 or 161 interrupts the operation of motor 105 (seen in FIG. 4) and terminates the rotation of cam 158 and the change of water flow between the nozzle tubes shown in FIGS. 3 and 4. It will be noted, that gear drive unit 106 (shown in FIGS. 3 and 4) includes cam 158 and cam switch 157 for both of the water flow control apparatus shown in FIGS. 3 and 4.

In operation, as shaft 107 rotates cam 158, cam switch 157 is inactive between cam lobes and is actuated as each cam lobe approaches the cam switch. Thus, between cam lobes, the rotation of cam 158 once initiated by the motor control apparatus shown in FIG. 6 continues until the next cam lobe actuates cam 157. Thus, in the embodiment of FIG. 5 in which three cam lobes are provided, cam switch 157 is actuated three times per revolution of cam 158. In the preferred embodiment of the present invention, the cooperation of cam switch 157 and cam 158 are utilized by the motor control circuit shown in FIG. 6 to ensure that the termination of water flow switching in response to a fountainhead selection signal in the manner described above, occurs at each of the three positions corresponding to the cam lobes. In this manner, the motor control allows the rotation of cam 158 and rotor 146 (seen in FIG. 4) or rotating plate 115 in the embodiment shown in FIG. 3 to stop only in positions in which alignment is provided between one of the nozzle tubes. In other words, the cooperation of cam switch 157 and cam 158 ensures that the flow control selector will not stop between alignment positions with the nozzle tubes.

Figure 6:
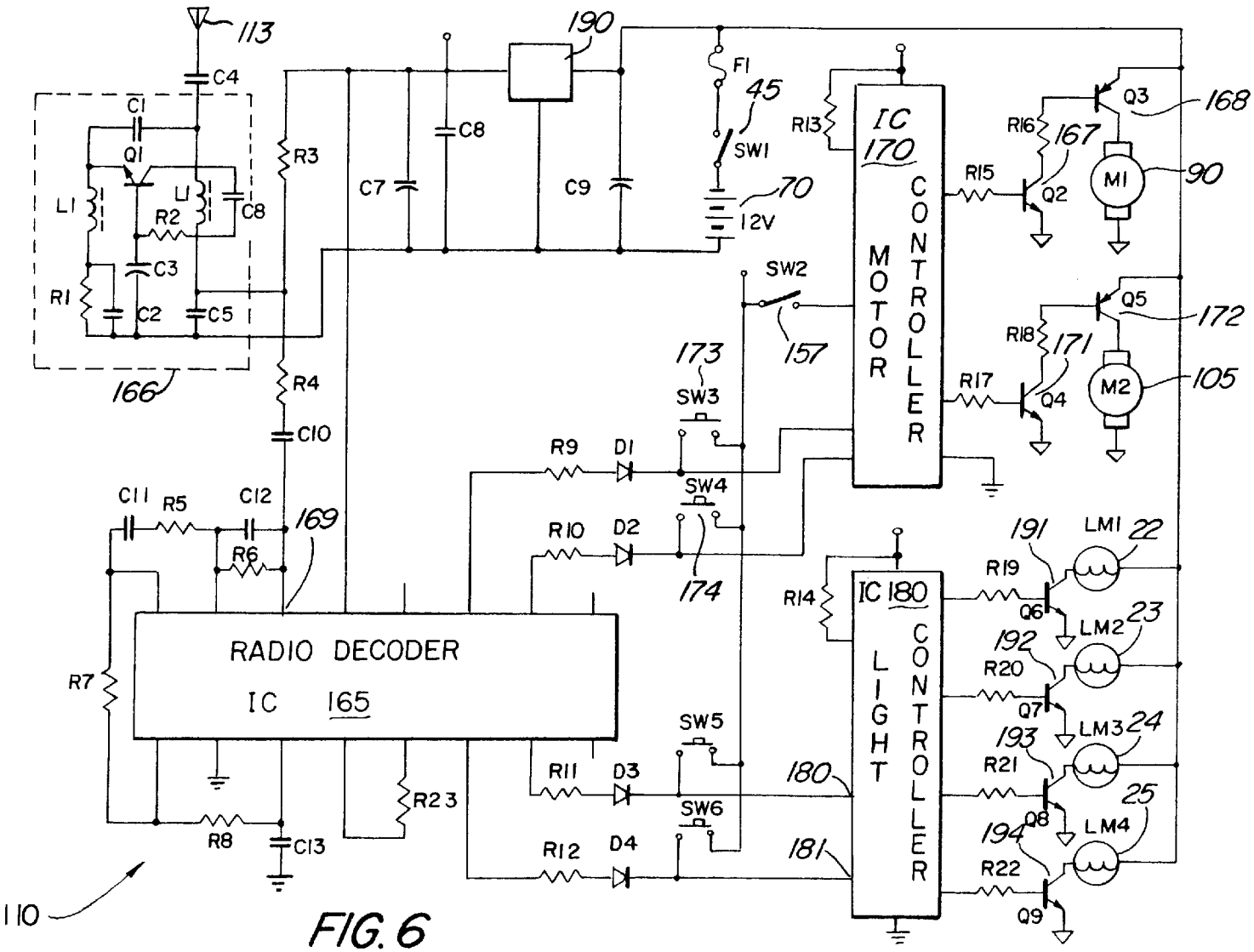
FIG. 6 sets forth a schematic diagram of the controller of the present invention.

FIG. 6 sets forth a schematic diagram of control circuit 110. As mentioned above, control circuit 110 may be fabricated in accordance with conventional fabrication techniques, and thus may be fabricated utilizing commercially available circuit components. Accordingly, control circuit 110 includes an input amplifier 166 utilizing a tuned radio frequency input stage coupled to an antenna 113. Input amplifier 166 is conventional in fabrication and utilizes an NPN transistor together with conventional tuning inductive and capacitive elements. The output of input amplifier 166 is coupled to an input terminal 169 of a RF signal decoder integrated circuit 165. Integrated circuit 165 is conventional in fabrication and in the embodiment shown in FIG. 6, is provided by a device manufactured by REALTEK device number RX2 integrated circuit. However, other equivalent integrated circuit devices may be utilized for providing the function of radio frequency signal decoder operation. The essential function of integrated circuit 165, is to convent the applied radio frequency signals at input 169 to digitally encoded signals which may utilized in controlling the plurality of motors and lamps within the present invention pool fountain.

Thus, an integrated circuit motor controller 170, which in the embodiment of FIG. 6, may comprise a conventional 4-bit microcontroller is operatively coupled to the output signals of integrated circuit 165. A switch 157, which as is better seen in FIG. 5, is operated by a cam 158 and is operatively coupled to integrated circuit 170. The function of switch 157 is to provide the termination of fountainhead switching set forth above in FIGS. 3 and 4 and described therein.

Motor control integrated circuit 170 is operatively coupled to a pair of amplifiers 167 and 171. Amplifier 167 serves as a preamplifier for a power amplifier transistor 168. Transistor 168 operatively controls pump motor 90. Similarly, amplifier 171 provides a preamplifier stage driving a power amplifier 172 which in turn controls the operation of flow control motor 105. Thus, in response to output signals from integrated circuit 165, motor control IC 170 operates pump motor 190 and flow control motor 105, in response to manual switch inputs or remote control signal inputs in the manner described above.

An integrated circuit light controller 180 which in the embodiment shown in FIG. 6, is provided by a conventional 4-bit microcontroller includes a pair of inputs 180 and 181 coupled to decoder integrated circuit 165. Integrated circuit 180 is operatively coupled to a plurality of switching transistors 191, 192, 193 and 194. Transistors 191 through 194 are coupled to light assemblies 22, 23, 24 and 25 respectively. The operation of transistors 191 through 194 is that of a simple switch, such that an output signal from integrated circuit 180 turns on the selected one of transistors 191 through 194. Each time one of transistors 191 through 194 is turned on, the corresponding light assembly is energized and provides the above described illumination. Thus, in response to decoded signals received from input amplifier 166 and decoded by integrated circuit 165, integrated circuit 180 controls transistors 191 through 194 to energize selected ones of light assemblies 22 through 25.

Figure 7:
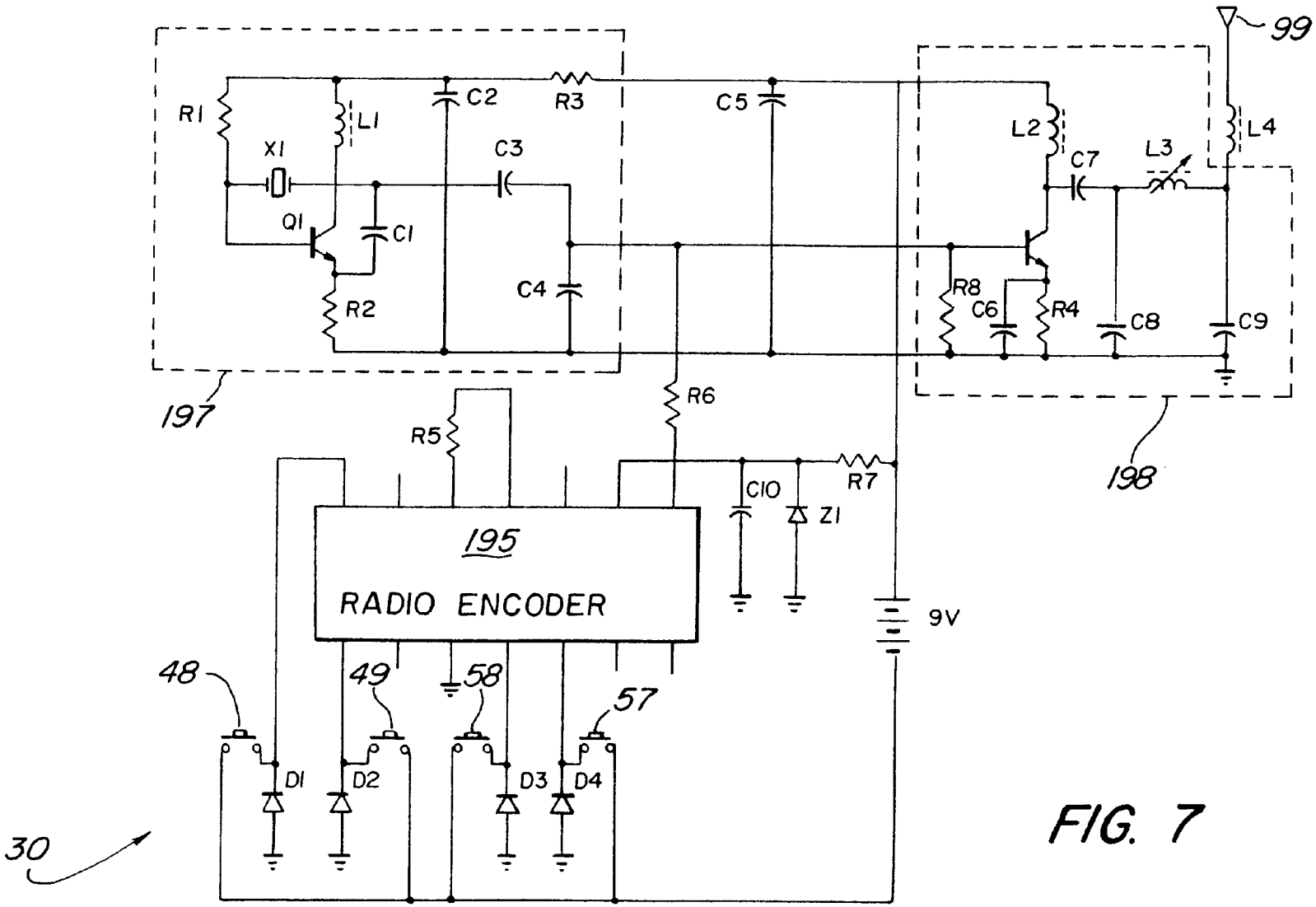
FIG. 7 sets forth a schematic diagram of the remote unit of the present invention pool fountain.

FIG. 7 sets forth a schematic diagram of the operative circuit within remote control unit 30. As mentioned above, remote control unit 30 utilizes a conventional four command remote control circuit which may be fabricated entirely in conventional fabrication techniques. The four command inputs described above are provided by user operated switches 48, 49, 57 and 58. An integrated circuit encoder 195 is conventional in fabrication and in the embodiment of FIG. 7, utilizes an integrated circuit manufactured by REALTEK device number TX2. However, it will be apparent to those skilled in the art that different integrated circuits having the signal encoder function of integrated circuit 195 may be utilized without departing from the spirit and scope of the present invention. Integrated circuit 195 responds to the actuation of any of switches 48, 49, 57 or 58 to produce a corresponding digitally encoding output signal at output 196.

A radio frequency oscillator 197 utilizes a conventional crystal controlled oscillator producing a radio frequency output signal. Accordingly, the digitally encoded signal from integrated circuit 195 is coupled to the output of radio frequency oscillator 197. The combination of digitally encoded control signal and the radio frequency output signal of oscillator 197 is applied to a tuned amplifier stage 198. Amplifier stage 198 is conventional in fabrication and comprises a tuned amplifier stage having optimal power gain for a predetermined bandwidth of radio frequency signals. In further accordance with conventional fabrication, the combined signal input from encoder 195 and oscillator 197 is amplified within tuned amplifier 198 and is transmitted from antenna 199. The digitally encoded signal from antenna 199 is received by antenna 113 of control circuit 110 (seen in FIG. 6) where it is decoded and utilized in controlling the operation of the present invention pool fountain.

FIG. 8 sets forth a perspective view of an alternate embodiment of the present invention generally referenced by numeral 150. Pool fountain 150 is set forth to illustrate an alternate embodiment of the present invention by which the physical appearance of the present invention pool fountain may resemble a shape substantially different from pool fountain 10 set forth in FIG. 1. Thus, by way of example and not limitation, pool fountain 150 includes a body portion 153 which ins operatively coupled to lower housings 151 and 152. In the example of FIG. 8, body 153 is generally shaped to resemble a creature such as a duck, bird or other animal. However, it will be understood by those skilled in the art that body 153 may be shaped in a variety of appearances such as fish, dolphins or other creatures without departing from the spirit and scope of the present invention.

Thus, body 153 supports a plurality of upwardly directed fountain nozzles 154 and a plurality of upwardly directed lights 155. It will be understood by those skilled in the art that nozzles 154 and lights 155 are operatively coupled to housings 151 and 152 in the same manner as set forth above in pool fountain 10. Thus, during operation, one or more of nozzles 154 is caused to produce an upwardly directed stream of water spray and lights 155 are operated in the manner described above to provide upwardly directed illumination beams for further effect. The importance of the embodiment of FIG. 8, is to illustrate that the present invention pool fountain may be fabricated in a variety of aesthetic themes without departing from the spirit and scope of the present invention.

Figure 9:
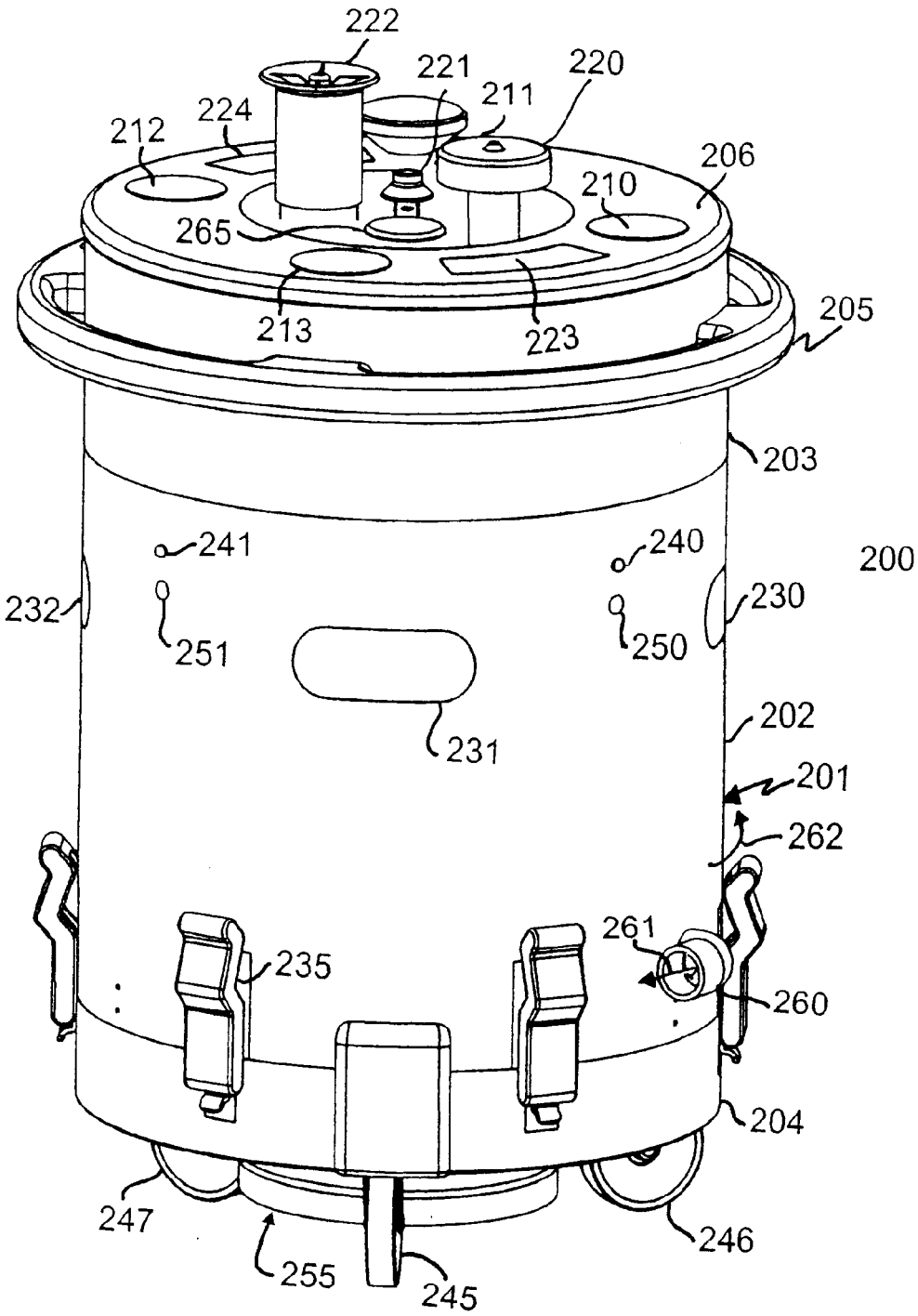
FIG. 9 sets forth a perspective view of a pool fountain and light device constructed in accordance with the present invention.

FIG. 9 sets forth a perspective view of an alternate embodiment of the present invention improved battery-powered remotely controlled floating pool fountain and light device generally referenced by numeral 200. Device 200 is generally cylindrical and shape and defines a generally cylindrical housing 201. Housing 201 is formed of a center housing 202 which supports an upper housing 203 and a lower housing 204. A plurality of snap latches 235 secure lower housing 204 to center housing 202. A bumper ring 205 extends outwardly from upper housing 203 and provides a convenient carrying handle and protective bumper for housing 201. Upper housing 203 further defines a generally planar upper surface 206 supporting a plurality of upwardly directed colored lights 210, 211, 212 and 213.

Fountain device 200 further includes a plurality of upwardly directed water spray nozzles 220, 221 and 222. For purposes of illustration, spray nozzles 220, 221 and 222 are shown raised above upper surface 206 in an assembly position. In different embodiments, one or more of nozzles 220, 221 or 222 may be supported above surface 206 to produce a particular spray pattern.

Center housing 202 further supports a plurality of outwardly directed pool lights 320, 321, 322 and 323 each include respective lenses 230, 231 and 232 (a fourth lens 233 is positioned on the opposite side of center housing 202 but not seen in FIG. 9). As described below, light energy directed outwardly through lenses 230, 231, 232 and 233 provide selective color illumination of the pool water as device 200 floats within a pool environment.

Figure 10:
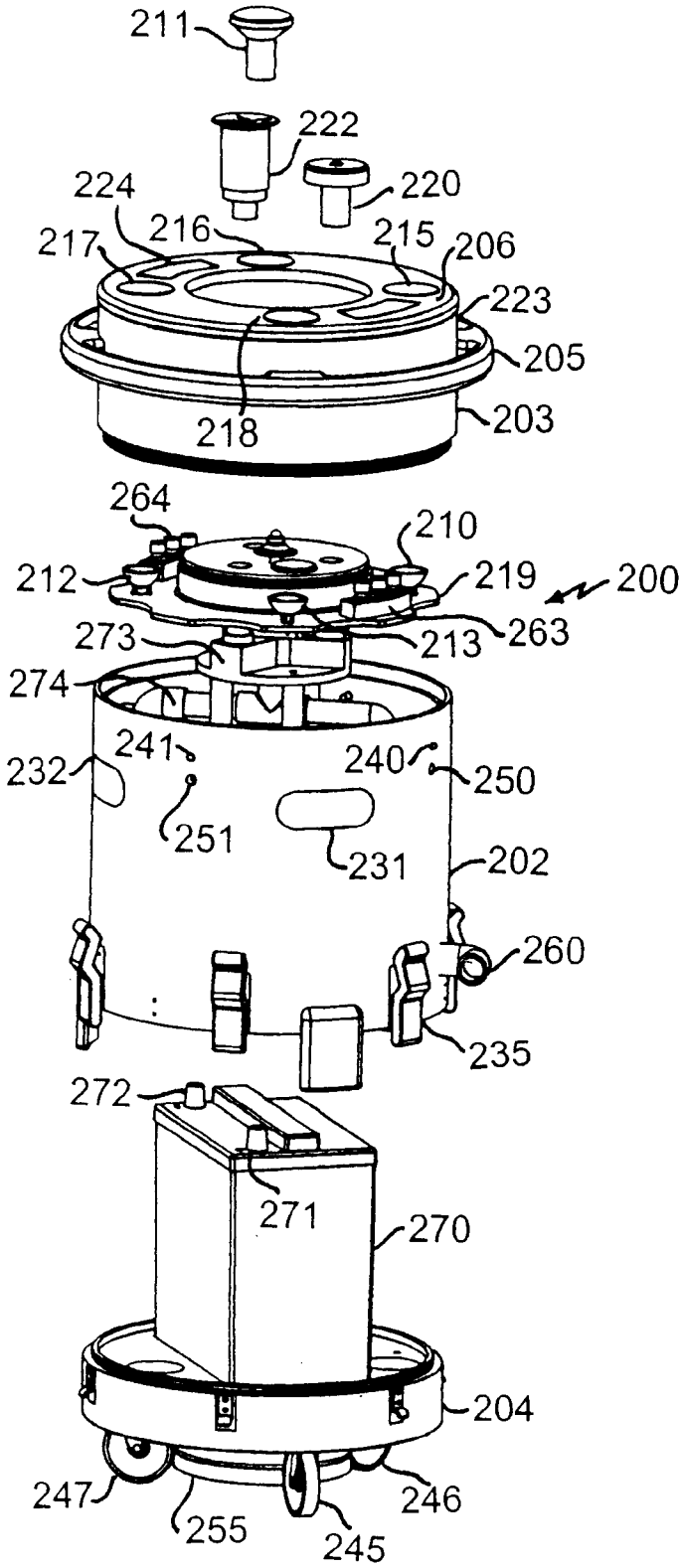
FIG. 10 sets forth a perspective assembly view of the present invention floating pool fountain and light device.

A plurality of flexible manual switch pads 223 and 224 provide for external access to a corresponding plurality of manual switches (switches 263 and 264 shown in FIG. 10). Pads 223 and 224 provide a water tight seal for upper housing 203.

An anchor 255 is supported beneath lower housing 204 in the manner set forth below. Suffice it to note here that anchor 255 may be lowered to provide fixed positioning of fountain device 200 within a pool environment. To ease the movement of fountain device 200 upon pavement or other surfaces, a plurality of supporting casters 245, 246 and 247 are also secured to lower housing 204.

A rotation jet 260 extends outwardly and sidewardly from housing 201 and is directed to provide a water flow in the direction indicated by arrow 261 when supplied with pressurized water. In response to a water flow from rotation jet 260 in the direction indicated by arrow 261, fountain device 200 rotates within the pool environment in the direction indicated by arrow 262.

In accordance with a further important advantage of the present invention embodiment shown in FIG. 9, a plurality of ultrasound transmitters and sensors 240, 241, 242 and 243 (transmitter sensors 242 and 243 not seen in FIG. 9 due to the perspective view thereof) are supported at equally spaced positions about center housing 202. A corresponding plurality of outwardly directed water jet nozzles 250, 251, 252 and 253 (water jet nozzles 252 and 253 not seen due the perspective view of FIG. 9) are supported in proximity to sensors 240 through 243.

In operation, in response to remote control signals provided in the manner described below, one or more of spray nozzles 220 through 222 are supplied with pressurized water to produce upwardly directed spray water patterns. Correspondingly and also by remote control set forth below in greater detail, one or more of colored lights 210 through 213 are selectively illuminated to provide coloration of the water spray patterns. In addition to remote control of water spray and spray illumination described below, the user within the pool environment is able to utilize manual switch pads 223 and 224 to manually control water spray and colored light illumination thereof.

In further response to remote control operation described below, pool lights 230 through 233 are selectively illuminatable to provide colored light input to the pool environment further enhancing the appeal of the present invention fountain device.

In addition to the upwardly directed fountain spray with programmable/controlled variable spray height and colored light illumination thereof as well as the colored light illumination of the pool environment, the energizing of rotation jet 260, also in response to remote control, produces a rotation of the entire body of fountain device 200 in the direction indicated by arrow 262 with the capability of programmable variable speed or remotely controlled speed of rotation. This in turn further enhances the entertainment and appeal of the present invention fountain device as the colorfully illuminated fountain sprays are rotated as the device floats within the pool environment.

In accordance with an important aspect of the present invention described below in greater detail, ultrasound transmitters and receivers 240 through 243 (transmitter receivers 242 and 243 not seen) continuously emit and receive ultrasound energy. Under normal circumstances, the energy emitted by sensor receivers 240 through 243 is not returned to the sensor portions thereof and fountain 200 maintains its normal operation. If, however, fountain device 200 floats too close to the edge of the pool environment or other obstruction, the ultrasound energies produced by one or more of sensor receivers 240 through 243 receives reflected ultrasound energy indicating the proximity of the pool edge or other obstruction. In such case and by means set forth below in greater detail, the return energy sensed by sensor receivers 240 through 243 causes the corresponding jet or jets 250 through 253 to be energized producing a water jet spray which urges fountain device 200 away from the detected object.

For example, if fountain device 200 floats into close proximity within the pool edge such that energy produced by sensor receiver 240 receives a return reflected energy, the system activates by means set forth below in greater detail to produce a jet of water from jet 250. This jet of water moves fountain device 200 away from the sensed object until sensor receiver 240 no longer detects reflected energy.

In other instances, energy may be received in reflection from more than one sensor. For example, fountain device 200 may float toward the pool edge or an obstructing object such that sensor receivers 240 and 241 both receive reflected energy. In such case, the system activates jets 250 and 251 to again move fountain device 200 in the appropriate direction away from the sensed pool edge or object until sensor receivers 240 and 241 no longer sense reflected ultrasound energy.

It will be apparent to those skilled in the art that while the automatic positioning apparatus provided by sensor receivers 240 through 243 together with water jets 250 through 253 is shown utilizing four equally spaced sensor receivers and water jets, a different number of sensor receiver and water jet groups may be used without departing from the spirit and scope of the present invention.

FIG. 10 set forth a perspective assembly view of fountain device 200. As described above, fountain device 200 is generally cylindrical in shape having a center housing 202, an upper housing 203 and a lower housing 204. A plurality of latches 235 secure lower housing 204 to center housing 202. Upper housing 203 is secured to center housing 202 in a water tight attachment utilizing conventional seals and fasteners (not shown). Upper housing 203 defines an upper surface 206 having water tight lenses 215, 216, 217 and 218 supported thereon. Upper housing 203 further supports resilient manual switch pads 223 and 224 together with a bumper ring 205. As mentioned above, bumper ring 205 also provides a convenient handle for carrying fountain device 200.

Center housing 202 further supports a plurality of sensor receivers 240 through 243 (sensor receivers 242 and 243 not seen) together with a plurality of water jets 250 through 253 (water jets 252 and 253 not seen). A plurality of pool lights having water tight lenses such as lenses 231 and 232 are also supported upon center housing 202. A rotation jet 260 is supported at the lower portion of center housing 202. As is better seen in FIG. 12, a plurality of pool lights 320, 321, 322 and 323 are supported within center housing 201 behind lenses 230, 231, 232 and 233.

A battery 270 having connecting terminals 271 and 272 is supported upon lower housing 204 and during assembly is received within center housing 202. A plurality of casters 245 through 247 support lower housing 204. An anchor 255 is supported beneath lower housing 204 and secured in the manner described below.

Figure 13:
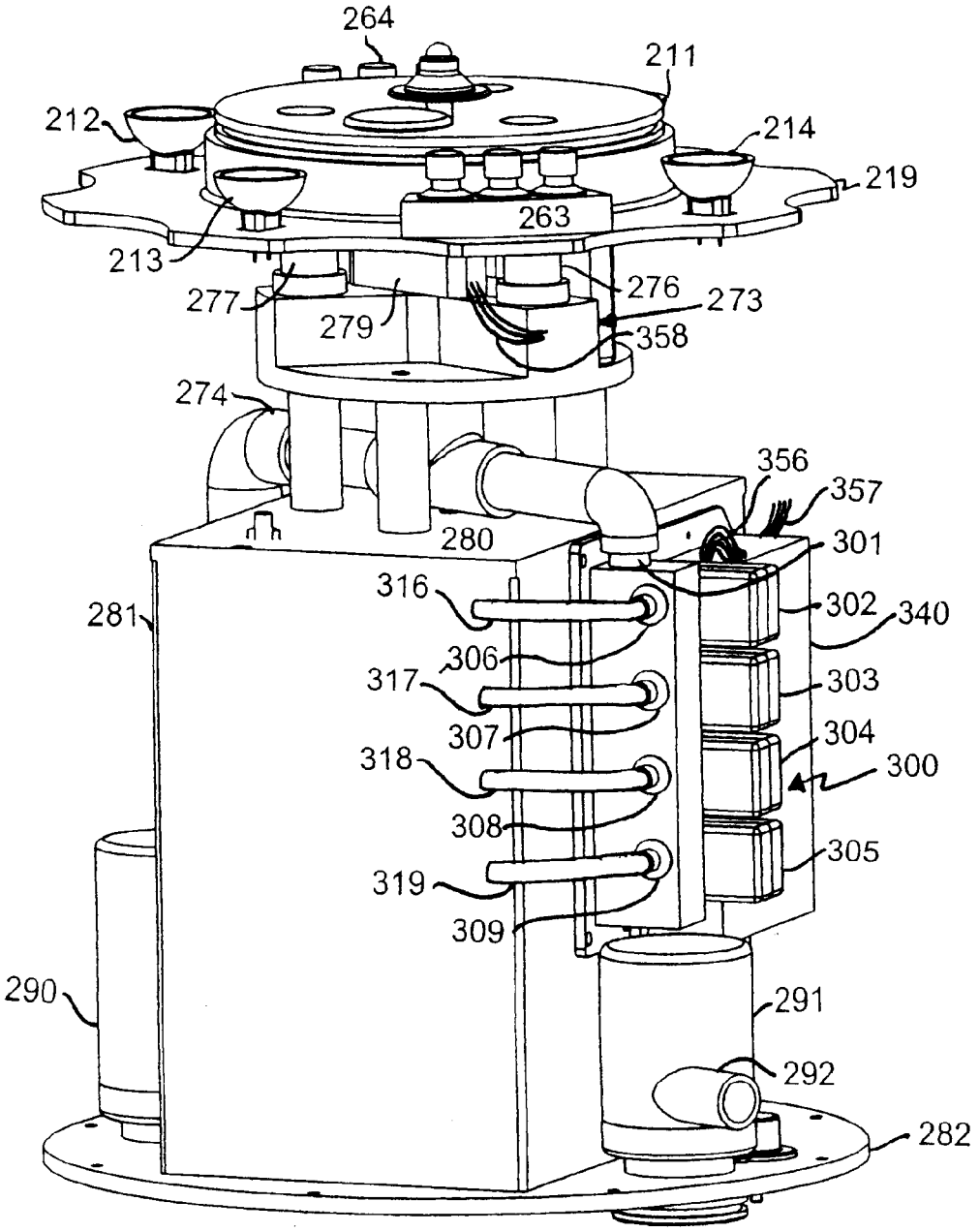
FIG. 13 sets forth a perspective view of the interior mechanism of the present invention floating pool and light device having the outer housing removed.

Within center housing 202, a water flow pipe 274 extends beneath a multiple water flow valve 273. Pipe 274 is operatively coupled to the input of multiple water flow valve 273 and is operative in the manner described below to selectively distribute water flow within pipe 274 to the selected one or combinations of spray nozzles 220, 221 and 222 (seen in FIG. 9). Suffice it to note here that multiple water flow valve 273 is fabricated in accordance with conventional fabrication techniques and receives a center input from the underside thereof which is selectively directed to one or more of the upwardly extending outlets of the water flow valve to provide the desired water spray selection. By means set forth below in greater detail, pipe 274 extends downwardly and is coupled to the water jet distribution apparatus which drives water jets 250 through 254 in the manner seen in FIG. 13. As is also seen in FIG. 13, rotation jet 260 is operated by an independent battery powered water pump with variable speed.

Figure 12:
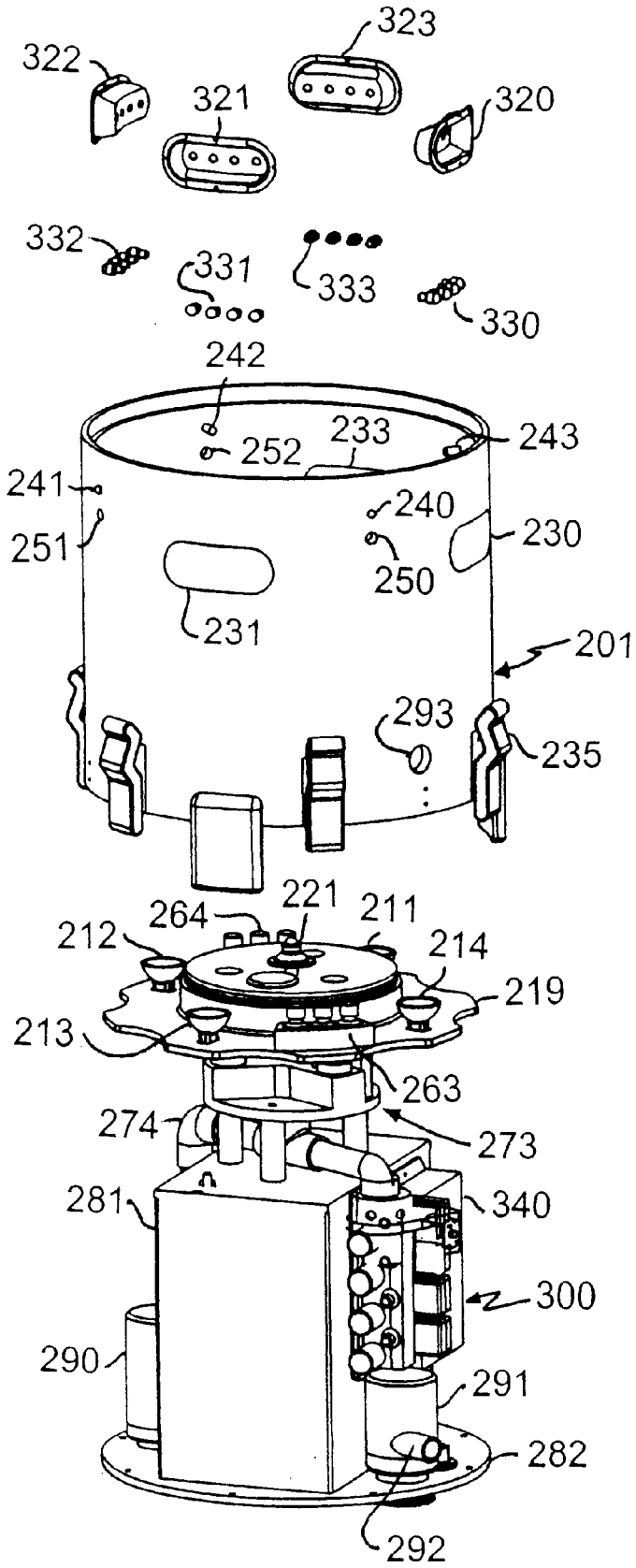
FIG. 12 sets forth a further perspective assembly view of the present invention floating pool fountain and light device.

It should be noted that in the embodiment of FIG. 12, multiple waterflow valve 273 is a three-way valve. However, as mentioned below, different numbers of spray nozzles and water flow valves may be used without departing from the spirit and scope of the present invention.

A support plate 219 is supported within center housing 202 above multiple water flow valve 273. Support plate 219 provides physical support for a plurality of colored lights 210, 211, 212 and 213. In addition, support plate 219 provides support for spray nozzles 220, 221, and 222 together with manual switches 263 and 264 and battery charger cap and plug 265 (seen in FIG. 9).

Figure 11:
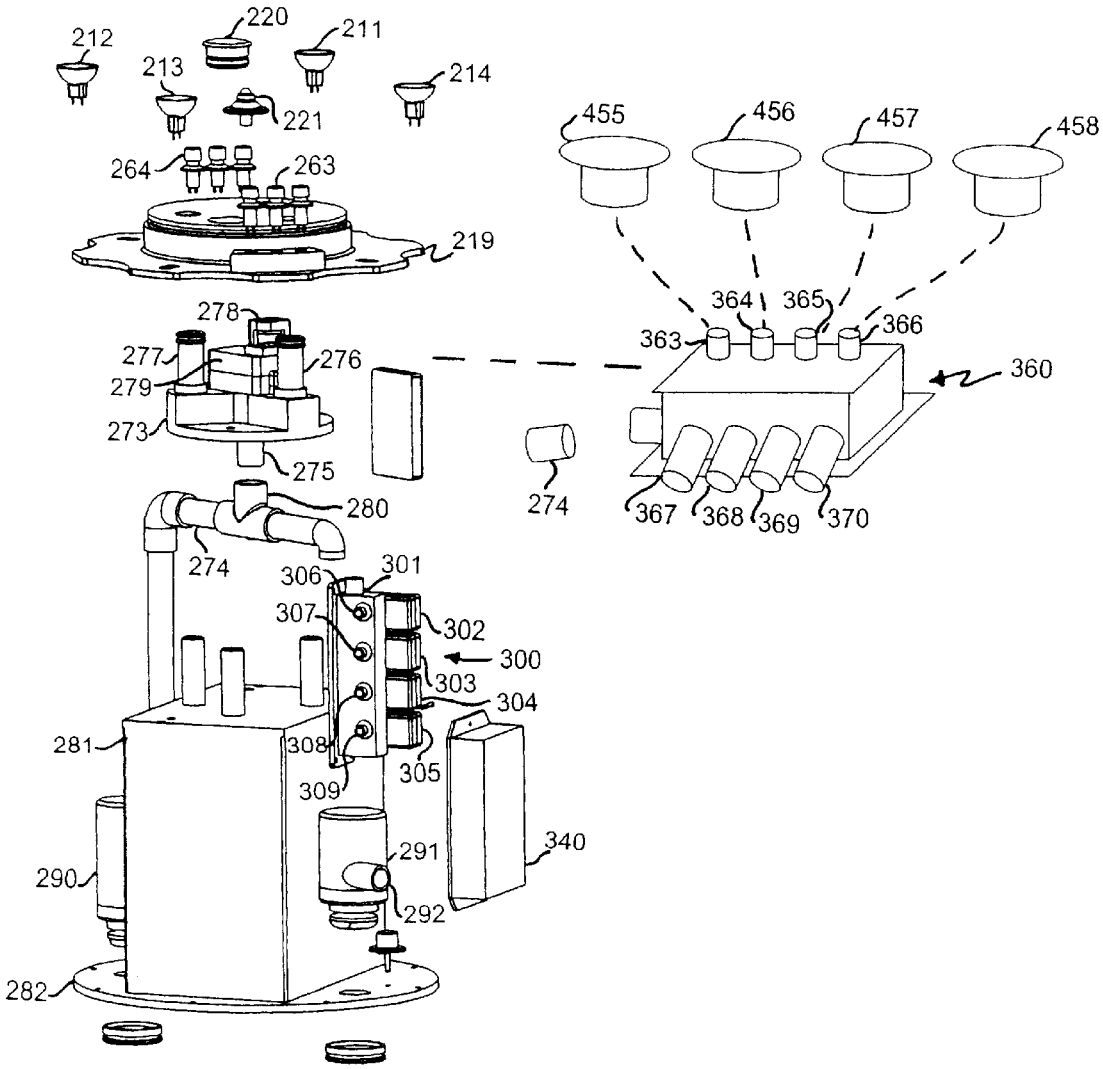
FIG. 11 sets forth a perspective assembly view of the interior apparatus of the present invention floating pool fountain and light.

FIG. 11 sets forth a perspective assembly view of the interior mechanism of fountain device 200. A lower plate 282 supports a variable spray motor and pump 290 together with a variable speed rotation motor and pump 291. A battery housing 281 is supported by bottom plate 282 and encloses battery 270 (seen in FIG. 10). A water flow pipe 274 is coupled to spray motor pump 290 and includes a tee coupler 280. A directional jet distribution control 300 includes an input coupler 301 joined to pipe 274 together with a plurality of outputs 306, 307, 308 and 309. Control 300 further includes a plurality of actuators 302, 303, 304 and 305 which by means set forth below in greater detail operate to direct water flow received from pipe 274 outwardly through one or more of outlets 306 through 309. A cover 310 fits over control 300 to provide protection. By means not shown, a plurality of connecting water lines are coupled between outputs 306 through 309 and water jets 250 through 253 (seen in FIG. 9) to provide the above-described directional water flow to maintain the position of the present invention floating fountain and light device.

A multiple valve 273 which, in the embodiment shown in FIG. 11 comprises a three-way valve, includes a common input 275 coupled to tee coupler 280 together with a trio of output couplers 276, 277 and 278. A valve actuator 279 operatively directs the input water flow received at input 275 to one or more of outputs 276 through 278. Three-way valve 273 may be fabricated in accordance with conventional fabrication techniques.

As described above, support plate 219 is supported within center housing 202 (seen in FIG. 10) and further supports a plurality of manual switches 263 and 264 together with a plurality of colored lights 211 through 214. A trio of spray nozzles 220, 221 and 222 (seen in FIG. 9) are coupled to output couplers 276 through 278 of three-way valve 273. Thus, the actuation of three-way valve 273 directs the water flow in pipe 274 from motor pump 290 upwardly through one or more of spray nozzles 220 through 222.

Also shown in FIG. 11 is an alternate configuration of multiflow valve and fountain spray nozzles. In this alternate embodiment, a group of four spray nozzles 455,456, 457 and 458 are coupled to outlets 363, 364, 365 and 366 respectively of distribution valve 360. Multiple flow distribution valve 360 is set forth in FIG. 21 and described below in greater detail. Suffice it to note here that the four way valve provided by valve 360 may alternatively be coupled to input pipe 274 in place of multiple valve 273 to provide flow to nozzles 455, 456, 457, and/or 458. It will be apparent that other numbers of spray nozzles and corresponding valves may also be used without departing from the spirit and scope of the present invention.

FIG. 12 sets forth a further perspective assembly view of the present invention floating pool fountain and light device. Of particular interest in FIG. 12 is the assembly of components within center housing 202. More specifically, FIG. 12 shows center housing 201 having a plurality of latches 235 supported thereon. Center housing 201 further supports a plurality of pool lenses 230, 231, 232 (seen in FIG. 9) and 233. Center housing 201 further defines an aperture 293. A plurality of sensor receivers 240, 241, 242 and 243 are positioned in an equally spaced arrangement about center housing 201. Correspondingly, a plurality of directional water jets 250, 251, 252 and 253 (not seen) are supported by center housing 201 in proximity to sensor receivers 240 through 243.

A plurality of light assemblies 320, 321, 322 and 323 are secured within center housing 201 using conventional attachment means (not shown). Light assemblies 320 through 323 are supported behind lens 230 through 233 respectively. Light assemblies 320 through 323 each receive a plurality of colored bulbs 330, 331, 332 and 333 respectively. Light assemblies 320 through 323 contain conventional bulb sockets for receiving and supporting the respective pluralities of colored light bulbs therein and for making appropriate electrical connections thereto. While the electrical connections to the pluralities of colored light bulbs within light assemblies 320 through 323 is not shown, it will be understood that such connection may be made utilizing conventional electric wiring.

A bottom plate 282 supports variable speed motor pumps 290 and 291 together with a battery housing 281. A directional jet distribution control 300 is also supported upon battery housing 281. Rotation motor pump 291 includes a pump outlet 292. Correspondingly, an aperture 293 is formed within center housing 201 through which water flow connection to outlet 292 for supporting rotation jet 260 (seen in FIG. 9) may be accomplished. A water flow pipe 274 couples water flow from motor pump 290 to control unit 300 and a multiple valve 273. A support plate 219 supports manual switches 263 and 264 together with colored lights 211 through 214.

In assembling the present invention floating pool fountain and light device, center housing 201 having light housings 320 through 323 and colored bulbs 330 through 333 assembled thereto is placed over the remaining structure shown in FIG. 12 until bottom plate 282 is secured to the lower portion of housing 201 using conventional fasteners (not shown).

FIG. 13 sets forth a perspective view of the assembly of the pump and water flow portions of the present invention floating pool fountain and light device. As described above, a bottom plate 282 supports a pair of variable motor pumps 290 and 291. Motor pump 290 provides a flow of pressurized water to a coupling pipe 274 which supplies the upwardly directed fountain sprays of the present invention device. Motor pump 291 which includes an outlet 292 provides a directed flow of water outwardly through rotation jet 260 (seen in FIG. 9) which operates to rotates the entire fountain device when floating in a pool environment. Pipe 274 is further coupled to a directional jet distribution control 300. Control 300 includes a plurality of valve actuators 302, 303, 304 and 305 which provide selective coupling of water flow to a corresponding plurality of water flow outlets 306, 307, 308 and 309. Outlets 306, 307, 308 and 309 are coupled to a plurality of water lines 316, 317, 318 and 319 respectively. By means not shown but in accordance with conventional fabrication techniques, water lines 316 through 319 are coupled to water jets 250 through 253 (seen in FIG. 12) to provide the above-described directional water jets used in the present invention automatic maneuvering and spacing mechanism. Actuators 302 through 305 respond to control signal inputs from sensor receivers 240 through 243 (seen in FIG. 12) in accordance with the circuit set forth below in greater detail to selectively couple water flow to the appropriate ones of lines 316 through 319.

A multiple water flow valve 273 is coupled to tee coupler 280 of pipe 274 and provides directional water flow coupling to couplers 276, 277 and 278 (the latter seen in FIG. 11). A support plate 219 is secured to couplers 276, 277 and 278 of multiple water flow valve 273 and further supports a plurality of colored lights 211 through 214 together with manual switches 263 and 264.

Figure 14:
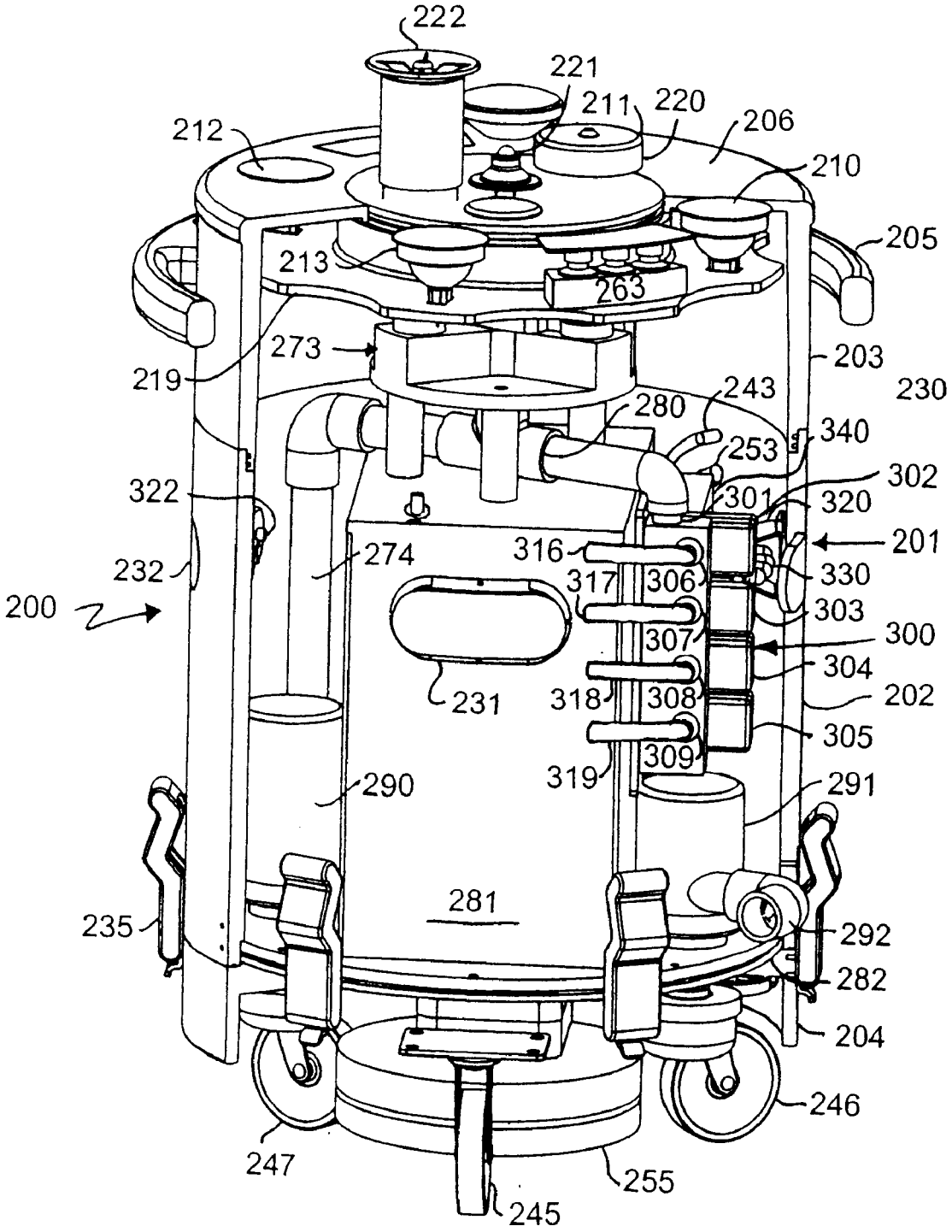
FIG. 14 sets forth a section view of the present invention floating pool fountain and light device.

FIG. 14 sets forth a partial section view of fountain device 200 having the apparatus shown in FIG. 13 secured within housing 201 in a completed structure. More specifically, housing 201 includes a center housing 202, an upper housing 203 and a lower housing 204. Upper housing 203 supports a bumper 205 and defines an upper surface 206. Support plate 219 supports a plurality of upwardly directed fountain spray nozzles 220, 221 and 222. A plate 219 supported within the interior of upper housing 203 supports a plurality of colored lights 210, 211, 212 and 213. A plurality of manually operated switches 263 and 264 (the latter seen in FIG. 9) are supported beneath surface 206.

Lower housing 204 is secured to center housing 202 by a plurality of latches 235. Lower housing 204 supports a bottom plate 282 having a plurality of casters 245, 246 and 247 together with an anchor 255 supported thereon. Plate 282 further supports a pair of motor pumps 290 and 291 together with a battery case 281. As is better seen in FIG. 10, battery housing 281 supports a battery 270. A water pipe 274 extends upwardly from motor pump 290 and includes a tee coupler 280 which in turn is coupled to multiple valve 273. Valve 273 is operatively coupled to fountain spray nozzles 220, 221 and 222. The remaining end of pipe 274 is coupled to a directional jet distribution control 300. Control 300 includes an input 301 joined to pipe 274 and a plurality of outlets 306, 307, 308 and 309. Outlets 306 through 309 are operatively coupled to a plurality of directional water jets 250 through 253 (seen in FIG. 12) by a plurality of water lines 316 through 319 respectively. A plurality of actuators 302, 303, 304 and 305 within control 300 are operative to direct water flow from input 301 to one or more of water lines 316 through 319 as needed to provide the above-described automatic positioning of the present invention fountain unit.

A plurality of light assemblies 320, 321, 322 and 323 (assembly 323 seen in FIG. 12) are further supported upon center housing 202. As described above in FIG. 12, each of light assemblies 320 through 323 includes a respective light housing within which a plurality of colored light bulbs are supported. In FIG. 14, light assembly 320 having colored bulbs 330 therein is shown in section view. While not seen in FIG. 14, it will be apparent to those skilled in the art that a plurality of conventional wiring elements couple the light assemblies to a electronic control unit 340. Electronic control unit 340 is set forth below in greater detail. Suffice it to note here that control unit 340 provides the basic main controller function of the present invention floating pool fountain and light device.

Figure 15:
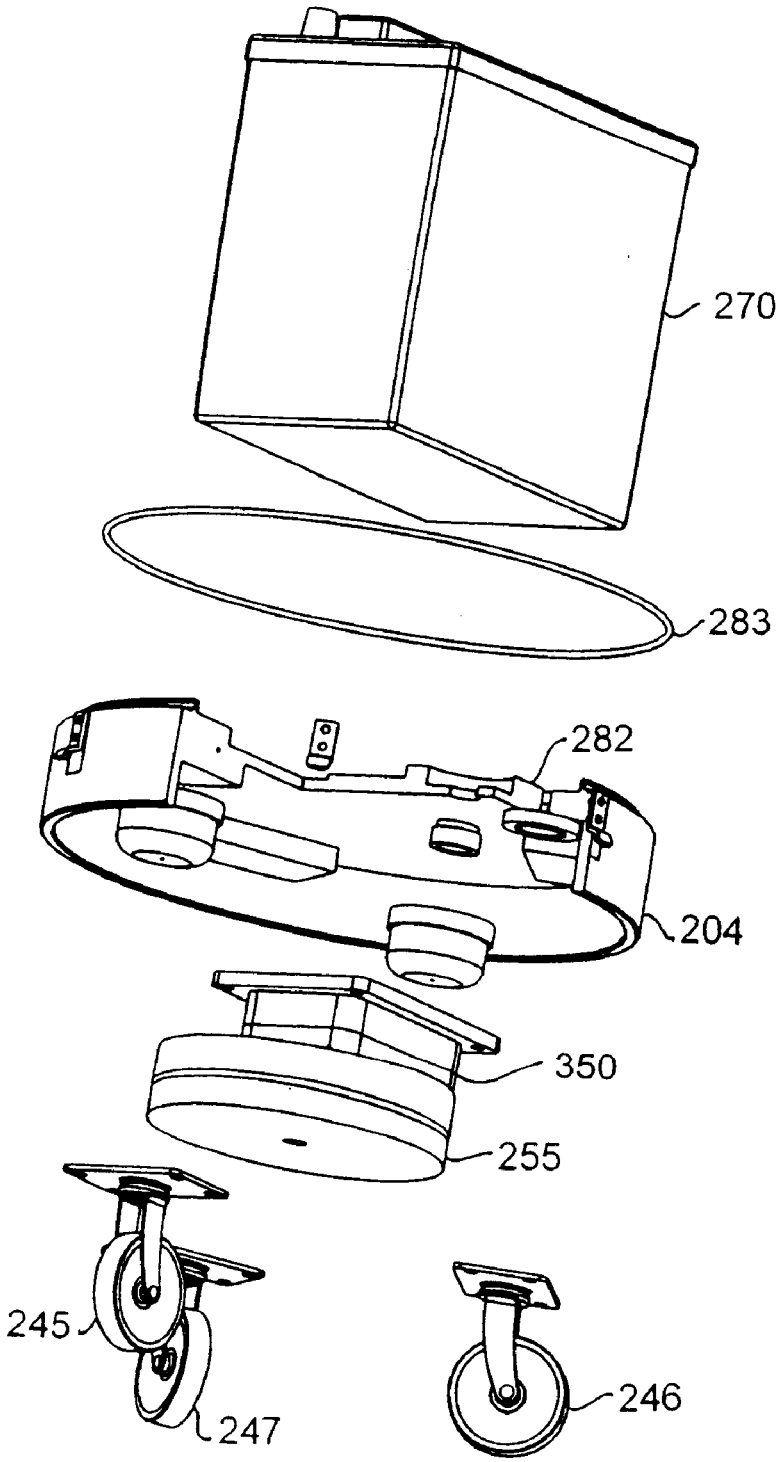
FIG. 15 sets forth a perspective assembly view of the anchor and caster support system of the present invention floating pool fountain and light device.

FIG. 15 sets forth a perspective assembly view of the lower portion of fountain 200 with particular attention to the anchor support mechanism and caster support mechanism thereof.

More specifically, lower housing 204 is secured to a bottom plate 282. A seal 283 is also supported upon bottom plate 282. A battery 270 which, as is better seen in FIG. 10, is enclosed within a battery housing 281 (seen in FIG. 14) is supported upon bottom plate 282. A motor drive 350 is secured beneath bottom plate 282 and further supports an anchor 255. A plurality of casters 245, 246 and 247 are secured to the underside of battery plate 282.

In the assembly of battery 270 and seal 283 to lower housing 204, conventional attachment is carried forward in which the above-mentioned battery housing is positioned upon battery 270. Motor drive 350 supports anchor 255 in the manner set forth below in FIG. 17 while casters 245 through 247 are used to support the entire unit when the present invention floating pool fountain and light device is supported upon dry land.

Figure 16:
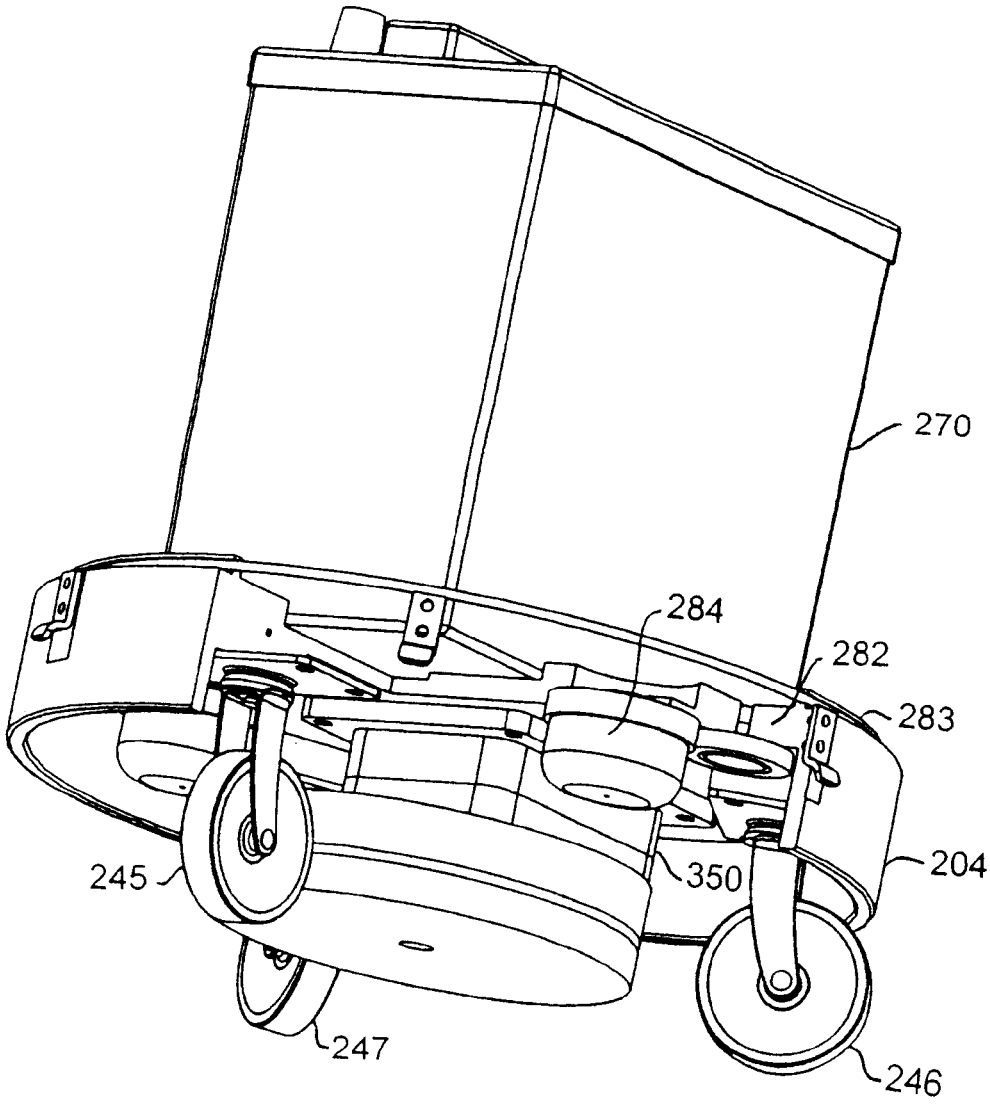
FIG. 16 sets forth a partially sectioned perspective view of the lower portion of the present invention floating pool fountain and light device.

FIG. 16 sets forth a partially sectioned view of the assembly of components shown in FIG. 15 which correspond generally to the lowermost portion of the present invention floating pool fountain and light device.

More specifically, lower housing 204 is secured to a bottom plate 282. A seal 283 is also supported upon bottom plate 282. A battery 270 which, as is better seen in FIG. 10, is enclosed within a battery housing 281 (seen in FIG. 14) is supported upon bottom plate 282. A motor drive 350 is secured beneath bottom plate 282 and further supports an anchor 255. A plurality of casters 245, 246 and 247 and intake filter 284 for rotation pump 291 are secured to the underside of battery plate 282.

Figure 17:
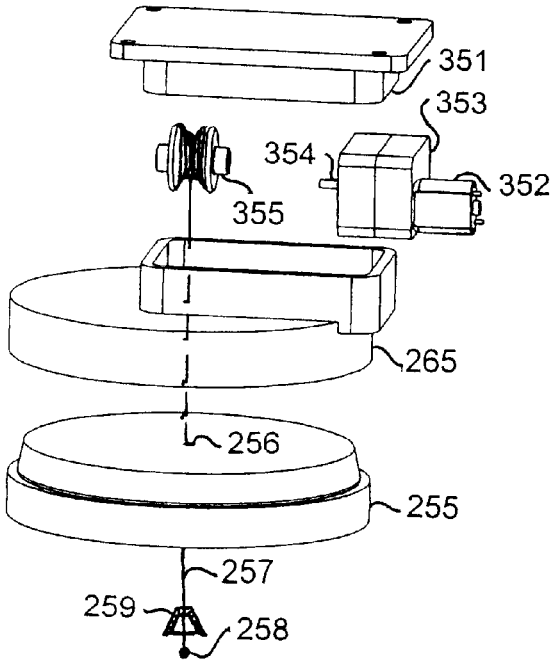
FIG. 17 sets forth a perspective assembly view of the anchor support apparatus of the present invention floating pool fountain and light device.

FIG. 17 sets forth a perspective assembly view of the anchor support apparatus utilized in the present invention floating pool fountain and light device. An anchor 255 defines a center aperture 256 through which an anchor line 257 passes. The lower end of anchor 257 passes through a plug 259 and terminates in an enlarged bead 258. The upper end of anchor line 257 is wound upon a spool 355. An anchor housing 265 receives a housing 351 which in turn supports a motor 352 and a gear drive mechanism 353. Gear drive 353 terminates in an output shaft 354 which is coupled to spool 355. The combination of housing 351, motor 352, gear drive 353, output shaft 354 and spool 355 collectively form motor drive 350 shown in the above-described figures.

In operation, the energizing of motor 352 winds anchor line 257 upon spool 355 drawing bead 258 upwardly into plug 259. Thereafter, plug 259 is received upon the underside of anchor 255 after which continued operation of motor 353 raises anchor 255 into and against anchor housing 265 to position anchor 255 in the fully raised position shown in FIG. 16. Conversely, actuating motor 352 in the opposite direction rotates spool 355 allowing anchor line 257 to lower anchor 255 to the desired depth to obtain a fixed position for the present invention floating pool fountain and light device.

Figure 18:
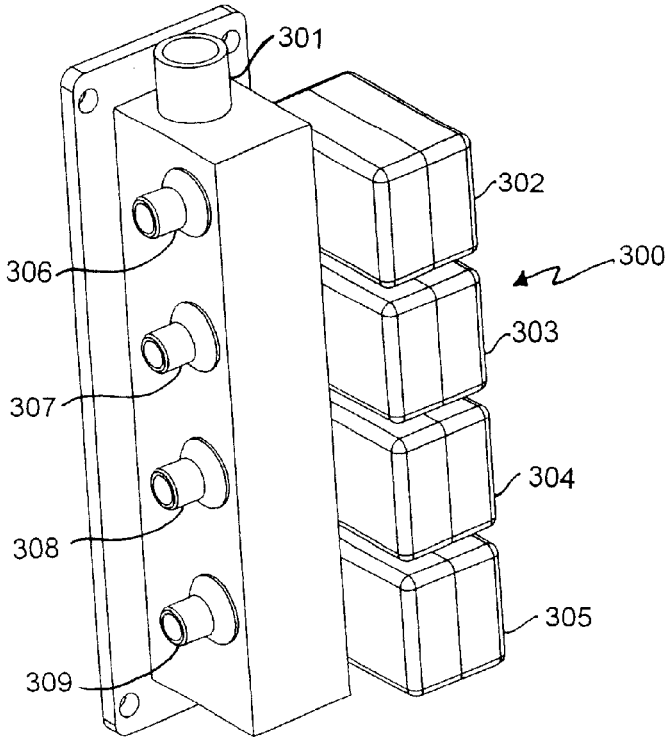
FIG. 18 sets forth a perspective view of the water jet distribution device of the present invention floating pool fountain and light.

FIG. 18 sets forth a perspective view of directional jet distribution control 300. As mentioned above, control 300 is utilized in distributing high pressure water received at its input between one or more of the directional jets supported upon center housing 202 in response to ultrasonic sensor receiver activity. Thus, the basic function of control 300 is the provision of water flow distribution to selected water jet outlets. Accordingly, control 300 includes an input 301 and a plurality of outputs 306, 307, 308 and 309. A corresponding plurality of actuators 302, 303, 304 and 305 are operatively coupled to the main control unit (seen in FIG. 25). Actuators 302 through 305 control the coupling of water from input 301 to selected ones of outlets 306 through 309.

Figure 19:
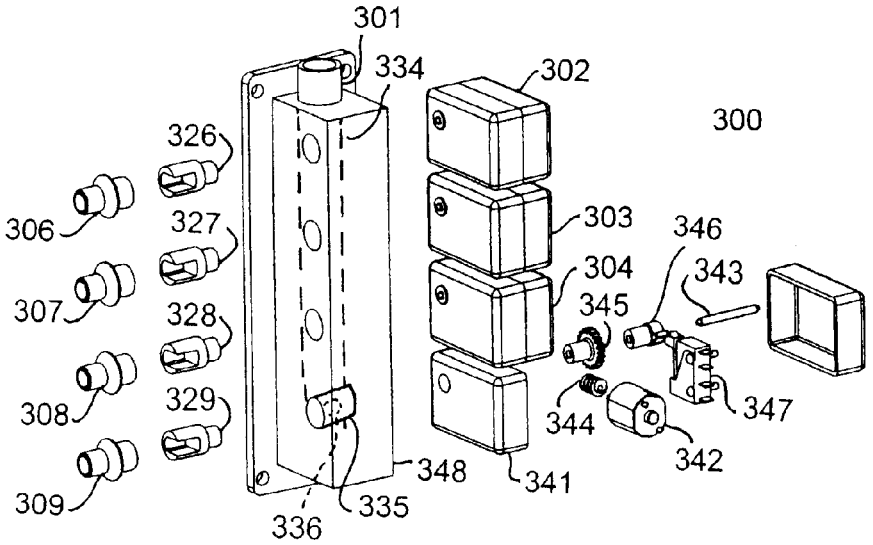
FIG. 19 sets forth a perspective assembly view of the water jet distribution device shown in FIG. 19.

FIG. 19 sets forth a perspective assembly view of control unit 300. As described above, control unit 300 includes an input 301 and a plurality of outputs 306 through 309. Outputs 306 through 309 are supported upon a main housing 348 within which a passage 334 communicates with a plurality of valve chambers. An illustrative valve chamber 335 having a flow aperture 336 within main housing 348 is shown for purposes of illustration. A valve unit 329 is rotatably supported within valve chamber 335 and is rotationally positioned by actuator 305. Thus, valve unit 329 is captivated within valve chamber 335 and is rotatable therein. Actuator 305 includes a case 341 within which a motor 342 is supported. Motor 342 drives a worm gear 344 which in turn rotates a gear 345. Gear 345 together with a cam 346 are rotatably supported by a shaft 343. A cam switch 347 is supported within case 341 and is actuated by cam 346. In operation, shaft 343 extends through cam 346, gear 345 and is joined to valve unit 329. Worm gear 344 drives gear 345 causing rotation of shaft 343 together with cam 346 and valve unit 329. When actuator 305 is energized, motor 342 rotates gear 345 together with cam 346 and valve unit 329. The rotation of valve unit 329 within valve chamber 335 either blocks aperture 336 or opens it to provide water flow outwardly through outlet 309. The position of cam 346 and switch 347 is selected to actuate switch 347 at the completion of a valve cycle.

Thus, energizing motor 342 causes rotation of valve unit 329 to block aperture 336 and close water flow to outlet 309. Further rotation of valve unit 329 by energizing motor 342 rotates valve unit 329 to the opposite position to the position shown in FIG. 19 thereby allowing water flow through aperture 336 outwardly through outlet 309.

It will be apparent to those skilled in the art that the remaining actuators 302 through 304 together with valve units 326 through 328 are correspondingly supported within control unit 300 and are operative in the same manner to produce control of water flow through outlets 306 through 308.

Figure 20:
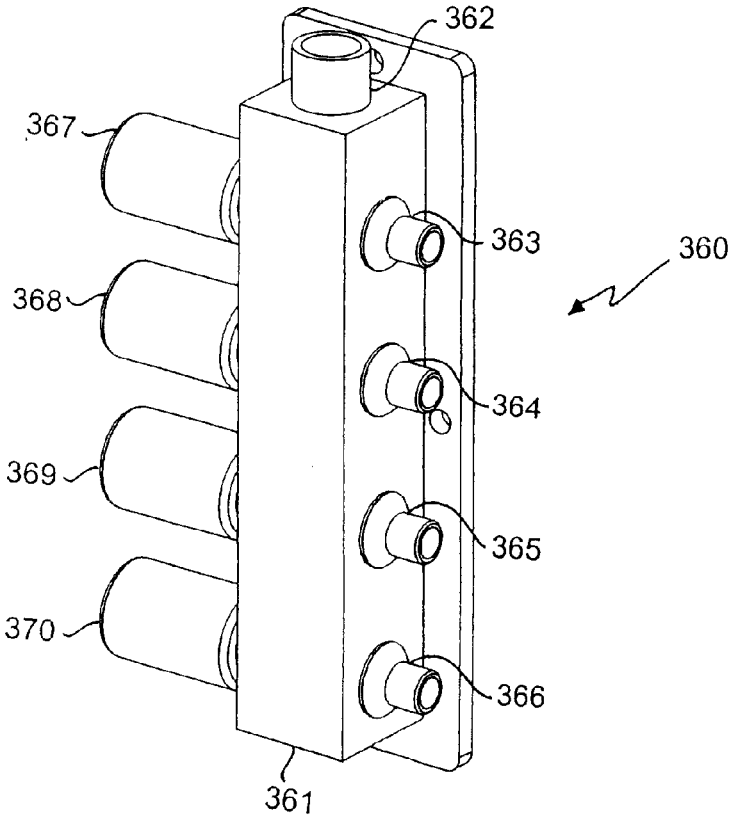
FIG. 20 sets forth a perspective view of an alternative embodiment water jet distribution device.

FIG. 20 sets forth a perspective view of an alternate directional jet distribution control which may be used in place of control unit 300 and which is generally referenced by numeral 360. Control unit 360 provides the identical overall function of diverting water flow selectively to one or more outlets to provide directional control jet flow for the present invention. Control unit 360 includes a housing 361 supporting a water flow inlet 362 and a plurality of outlets 363, 364, 365 and 366. Control unit 360 further includes a plurality of actuators 367, 368, 369 and 370. Control unit 360 differs from control unit 300 described above in that actuators 367 through 370 are linear solenoids directly coupled to their respective valve units without the need for intervening gear apparatus.

Figure 21:
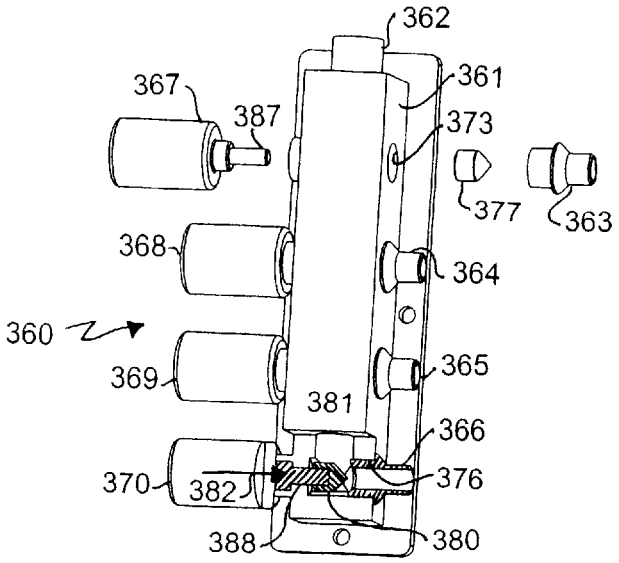
FIG. 21 sets forth a perspective assembly view of the alternative water jet distribution device of FIG. 20.

FIG. 21 sets forth a partially sectioned perspective assembly view of control unit 360. As described above, control unit 360 includes a housing 361 supporting a water inlet 362. A plurality of apertures 373, 374, 375 and 376 (apertures 374 and 375 not visible) are formed in housing 361 in communication with inlet 362 as described above. A plurality of valve units 377, 378, 379 and 380 (units 378 and 379 not seen) are supported within passage 381 and are moved by actuators 367 through 370. Outlets 363, 364, 365 and 366 are received within apertures 373 through 376 respectively and define cooperating valve seats for valve units 377 through 380. Actuators 367 through 370 which, as mentioned above, comprise rotational motors are directly coupled to valve units 377 through 380 respectively to provide movement between open and closed positions. In a similar manner to the operation described above, the positions of valve units 377 through 380 control flow coupling between water inlet 362 and outlets 363 through 366.

Figure 22:
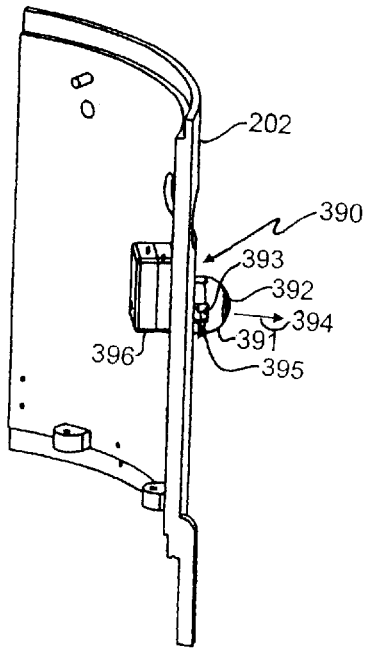
FIG. 22 sets forth a perspective view of a still further alternate embodiment of the present invention water jet distribution apparatus secured to a portion of the center housing.

FIG. 22 sets forth a perspective view of a still further alternate water jet mechanism for use in directional control in the present invention floating pool fountain and light device. The directional jet unit is shown secured to a sectional portion of center housing 202. Accordingly, a directional jet 390 includes a motor drive 396 secured to the interior portion of housing 202 together with an external shroud 391 secured on the outer surface of center housing 202. Shroud 391 defines an interior cavity and a plurality of apertures 395 around the base thereof. Shroud 391 further defines a center aperture 392. By means set forth below in greater detail, a rotatable impeller within shroud 391 driven by motor drive 396 produces a flow of water inwardly through apertures 393 in the direction indicated by arrow 395 which is forced outwardly through aperture 392 in the direction indicated by arrow 94. The outwardly directed jet of water flow produces the desired thrust to provide a directional thrust component used in the above-described automatic positioning of the present invention floating pool fountain and light device.

Figure 23:
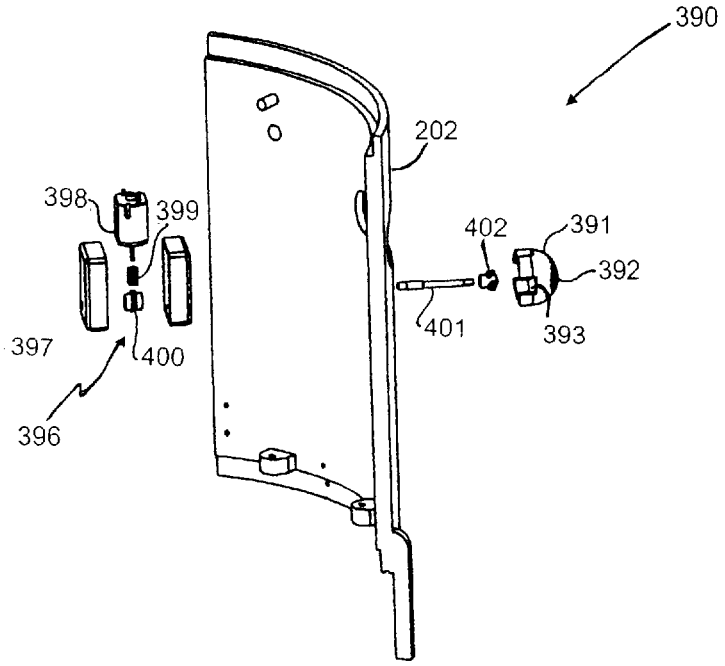
FIG. 23 sets forth a perspective assembly view of the water jet apparatus of FIG. 22.

FIG. 23 sets forth a perspective assembly view of directional jet 390. As described above, a shroud 391 having a center aperture 392 and a plurality of base apertures 393 is secured to the outer surface of center housing 202. A shaft 401 extends through an aperture formed in center housing 202 (not shown) and supports an impeller 402 within shroud 391. The interior end of shaft 401 is coupled to a gear 400 supported within a housing 397. Gear 400 is coupled to a worm gear 399 which is driven by a motor 398. Motor 398 and gear 399 are also supported within case 397.

Thus, energizing motor 398 rotates worm gear 399 which in turn rotates gear 400. The rotation of gear 400 produces a corresponding rotation of shaft 401 and impeller 402. The latter rotation provides the above-described directional water flow outwardly through aperture 392 to produce the desired directional thrust operative upon the present invention floating pool fountain and light device.

Figure 24:
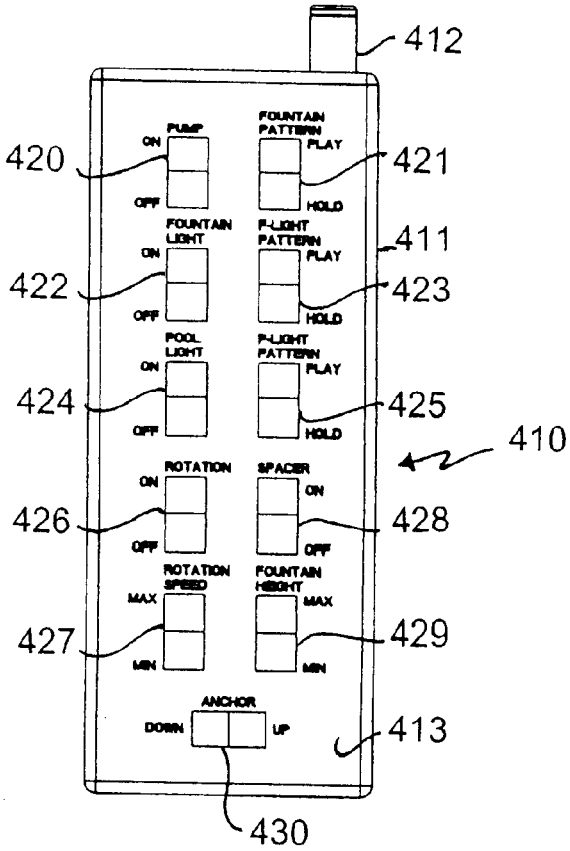
FIG. 24 sets forth a front view of the remote control apparatus of the present invention floating pool fountain and light.

FIG. 24 sets forth the remote control unit constructed in accordance with the present invention and for use in combination with the present invention floating pool fountain and light device which is generally referenced by numeral 410. Control unit 410 is operative in combination with electronic control unit 340 (seen in FIG. 13). With temporary reference to FIG. 13, it will be noted that electronic control unit 340 is operatively coupled to a plurality of connecting wires 356 which are coupled to directional jet distribution control 300. In addition, electronic control unit 340 includes a further plurality of connecting wires 357 which are coupled to multiple water flow valve 273 (which in the embodiment of FIG. 24 is a three-way valve) via a plurality of wires 358. Additional connections are provided for electrical connection within the present invention device to form the operative circuit set forth below in block diagram form in FIG. 25.

Returning to FIG. 24, remote control unit 410 includes a housing 411 and a transmitting antenna 412 both constructed in accordance with conventional fabrication techniques. Housing 411 includes a front face 413 upon which a plurality of switches 420 through 430 are supported. It will be apparent to those skilled in the art that the fabrication of remote control unit 410 and the cooperating electronic control unit 340 (seen in FIG. 13) is carried forward utilizing conventional remote control transmission receiving and decoding apparatus. In the preferred fabrication of the present invention, the remote control transmission mechanism utilized is that of radio frequency signals. However, it will be equally apparent to those skilled in the art that other communication methods such as inferred without departing from the spirit and scope of the present invention. The important function of control unit 410 in cooperation with electronic control unit 340 is the communication of control signals as the result of user manipulation of switches 420 through 430 to provide configuration and operation of the various apparatus operative within the present invention floating pool fountain and light device.

More specifically, surface 413 supports a variable speed pump on/off switch 420. This switch function to allow the user to remotely turn the spray fountain apparatus of the present invention on or off as desired. Utilizing switch 421, the user is able to select the spray pattern of the present invention fountain. When switch 421 is placed in the play position, the fountain will change the spray nozzle being utilized for a period of time and thereafter change to the next fountain nozzle and so on. Placing switch 421 in the hold position causes the present fountain nozzle to continue being used and maintains the current fountain spray pattern.

Switch 422 provides a on/off operation of the light mechanisms which illuminate the spray patterns utilizing lights 210 through 213 (seen in FIG. 9). Operation of switch 423 in the play position changes the colors of illumination of such lights in a given time sequence. Placing switch 423 in the hold positions maintains the current light color.

Switch 424 provides an on/off function for the pool lighting provided by pool lights 230 through 233 (seen in FIG. 12) which are supported about the center housing of the present invention floating pool fountain and light device. Switch 425 provides control signals which operate to choose the color of lights imparted to the pool environment. With switch 425 placed in the play position, the color of bulbs within the pool light assemblies is periodically changed. Placing switch 425 in the hold position maintains the current light color. Switch 426 provides an on/off function for the rotation of the present invention floating pool fountain and light device within the pool environment. It will be recalled that a separate variable speed rotation pump is operative within the present invention device to provide a flow of water thrusting laterally through rotation jet 260 (seen in FIG. 9) to produce rotation of the floating pool device. Switch 427 allows the speed of rotation to be adjusted. Positioning switch 427 in the maximum position causes an increase in the speed of rotation while positioning switch 427 in the minimum position causes a reduced speed of rotation.

Switch 428 provides an on/off function for the operation of the automatic spacer mechanism of the present invention floating pool fountain and light device. It will be recalled from the descriptions set forth above that the automatic spacer apparatus utilizes a plurality of sensors to determine proximity to a pool edge of large object and responds by turning on one or more directional water jets to move the device away from the pool edge or large object. The primary benefit of this function is, as mentioned above, to avoid splashing water from the fountain on to the side of deck surrounding the pool. Accordingly, switch 428 allows the user to remotely activate or deactivate this function.

Switch 429 is utilized in controlling the fountain spray height produced by the fountain nozzles of the present invention device. Moving switch 429 to the maximum position increases the height of fountain spray while moving switch 429 to the minimum position decreases the height of fountain spray. Variation of spray height is implemented by varying the speed (and therefore spray, flow and pressure) of pump 290.

Finally switch 430 of remote control unit 410 is operative to allow the user to raise and lower the anchor in the manner set forth above in FIG. 17. In the anticipated operation of switch 430, the user puts switch 430 in the up position to raise the anchor and allow movement of the floating pool fountain and light device and thereafter at the desired position lowers the anchor to the pool floor by placing switch 430 in the down position.

In the preferred fabrication the present invention, certain operational configurations are chosen in a default setting which operates in the absence of user provided remote control signals to the contrary. Thus, for example, the default setting of the light pattern for illumination of fountain spray which is controlled by switch 423 is the play mode in which colors vary over time. The default position for fountain spray pattern controlled by switch 421 is the play mode in which the fountain spray pattern changes periodically. Similarly, the default setting for the pool light pattern controlled by switch 425 is the play position in which the pool illumination colors vary from time to time. The rotational speed of the present invention device controlled by switch 427 is maintained in the minimum speed of rotation position as default setting. The operation of the automatic spacer mechanism controlled by switch 428 is maintained in the on position in its default setting while the fountain height controlled by switch 429 is maintained in its maximum fountain spray height as a default setting. In this manner, the basic operation of the present invention device is configured in the most likely favorable combination of settings as a "normal" or starting configuration from which the user may exercise control using remote control 410.

Figure 25:
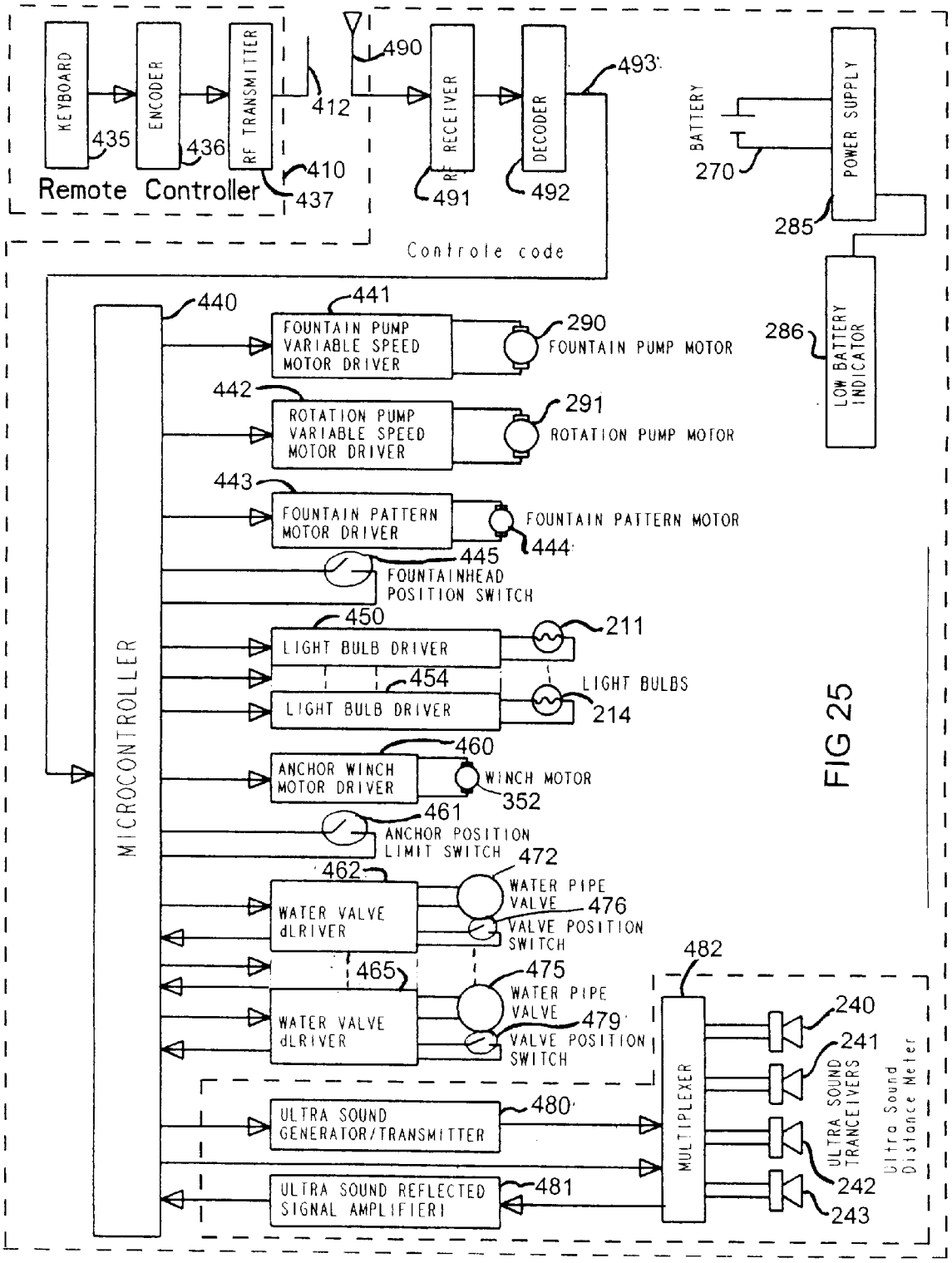
FIG. 25 sets forth a block diagram of the main controller of the present invention floating pool fountain and light.

FIG. 25 sets forth a block diagram of the operative apparatus within electronic control unit 340 and remote control unit 410. As described above, remote control unit 410 is utilized in providing a plurality of radio frequency signals which are encoded with control signals for use in operating the present invention floating pool fountain and light device. Accordingly, remote control unit 410 may be fabricated utilizing conventional digital electronic apparatus. Control unit 410 includes a keyboard 435 which supports and communicates with switches 420 through 430 (seen in FIG. 24). In response to switch inputs for keyboard 435, an encoder 436 configures digital electronic control signals which are coupled to a radio frequency transmitting circuit 437 which in turn modulates the control signals upon a suitable carrier and applies it to transmitting antenna 412.

Within electronic control unit 340, an antenna 490 receives the digitally encoded communication signal from remote unit 410 and couples it to a radio frequency receiver 491. Receiver 491 recovers the modulated signal from the carrier signal and applies it to a decoder 492. The output of decoder 492 at output 493 comprises the control signals originally produced by remote control unit 410. These control signals are applied to a microprocessor 440. Microprocessor 440 is fabricated in accordance with conventional fabrication techniques and is operative in accordance with a stored program or instructions set to provide the operation of the present invention unit. Accordingly, in response to decoded signals from decoder 492, microprocessor 440 is able to actuate a motor driver 491 which controls fountain pump motor 290. Similarly, microprocessor 440 is able to control a motor driver 442 to operate rotational pump motor 291. The fountain spray pattern selected by the three-way valve described above is operated in response to microprocessor 440 using a motor driver 443 which controls a fountain pattern motor 444. A position switch 445 provides an input signal to microprocessor 440 used in establishing a reference position for the fountain pattern. A plurality of light bulb drivers 450 through 454 are coupled to light bulbs 211 through 214 to provide the above described colored light illumination of the fountain spray. Control signals received by microprocessor 440 directed to control of the anchor position are coupled to a motor driver 460 which controls anchor motor 352. A limit switch 461 provides a return signal to microprocessor 440 to indicate a reference position for the systems anchor.

The above described automatic spacer apparatus of the present invention includes a plurality of valve drivers 462 through 465 which respond to control signals provided by microprocessor 440 to operate respective water valves 472 through 475. Valves 472 through 475 include position sensing switches 476 through 479 which produce reference signals back to microprocessor 440 to indicate valve position at a reference position. The ultrasound sensing and receiving apparatus of the present invention automatic spacer apparatus includes an ultrasound generator/transmitter 480 which responds to signals provided by microprocessor 440 to drive one input to a multiplexer 482. The return signal from multiplexer 482 is coupled to microprocessor 440 by a reflected signal amplifier 481.

A plurality of ultrasound transmitters and receivers 240 through 243 are operatively coupled to multiplexer 282. Thus, signals applied to transmitter 480 are coupled to sensor receivers 240 to 243 and return signals, if any, are coupled by multiplexer 482 to processor 440 via amplifier 481. In this manner, the above described automatic spacer operation is carried forward.

A battery 270 provides operative power to a conventional power supply 285 which includes a low battery indicator 286 also conventional in fabrication.

Figure 26:
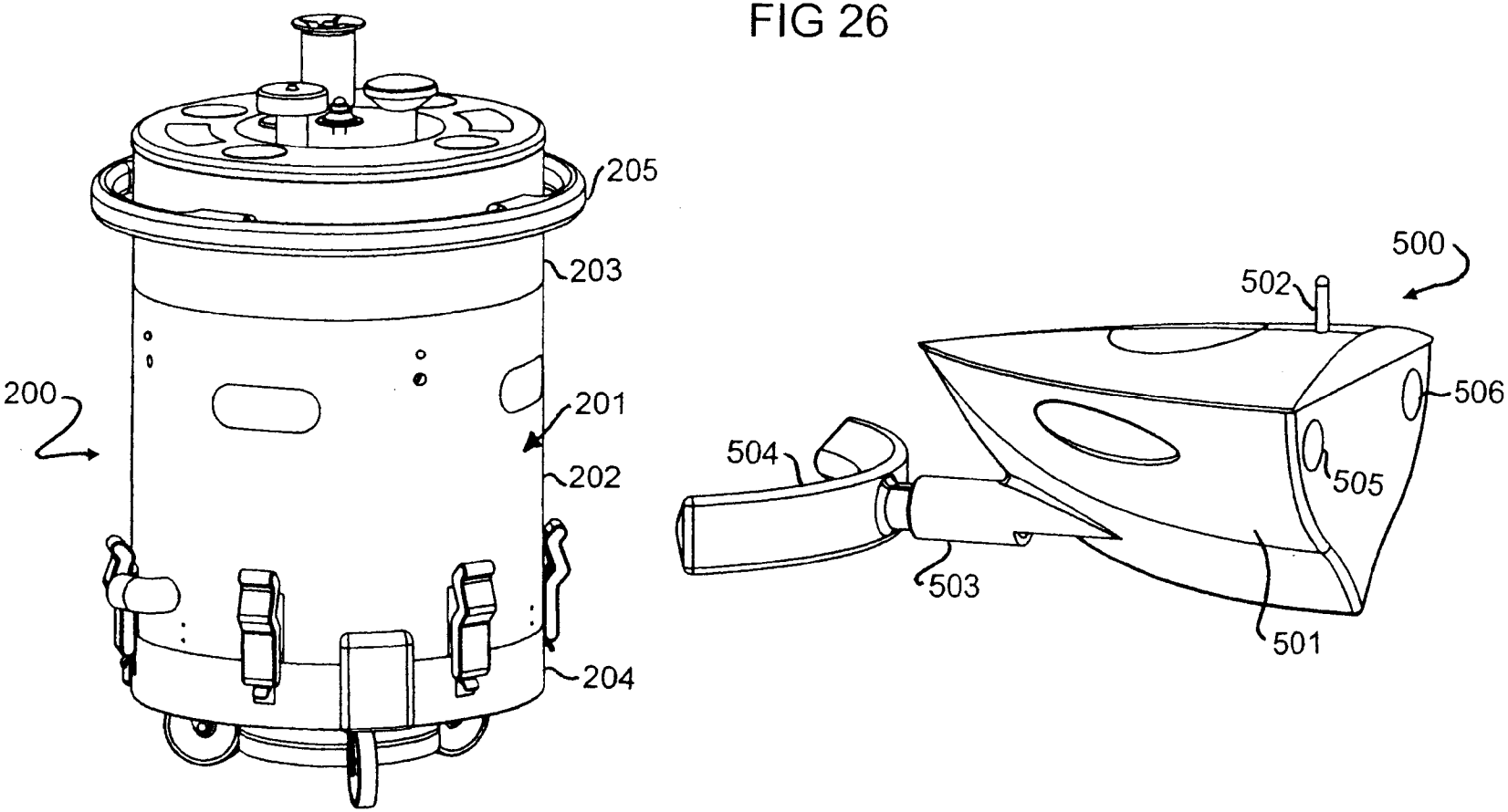
FIG. 26 sets forth a perspective view of the present invention floating pool fountain and light together with a remotely controlled moving device.

FIG. 26 sets forth a perspective view of the present invention floating pool fountain and light device 200 in combination with a remotely controlled device locator generally referenced by numeral 500. Device locator 500 includes a buoyant hull 510 having a post 503 extending forwardly therefrom. A gripping device or attachment bumper 504 is secured to post 503. A pair of motor driven propellers 505 and 506 are positioned on each side of the rear portion of hull 510. A receiving antenna 502 extends upwardly from hull 501 and is coupled to a control unit 510 having a battery 511 (seen in FIG. 28). Floating pool fountain and light device 200 is amply described above. Suffice it to note here, that device 200 includes a housing 201 which is also free floating or buoyant and which is composed of a center portion 202 and upper portion 203 and a lower portion 204. A bumper ring 205 encircles the upper portion of upper housing 203.

Figure 27:
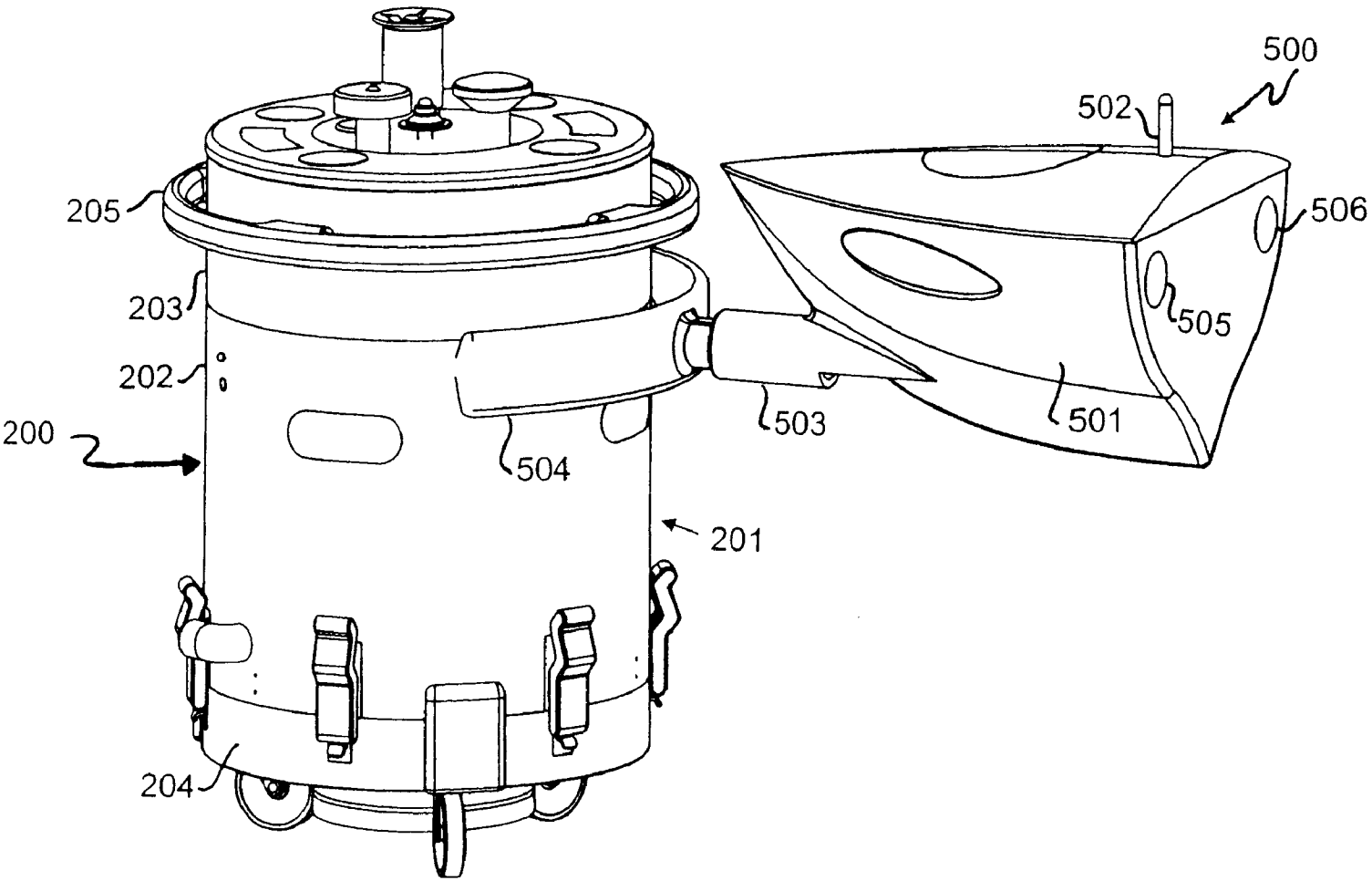
FIG. 27 sets forth a perspective view of the present invention floating pool fountain and light having the moving device coupled thereto.

In operation, the user employs a remote control unit 520 (seen in FIG. 29) to maneuver device locator 500 into contact with floating pool fountain and light device 200 in the manner shown in FIG. 27. Thereafter, the user operates device 500 to manipulate and position device 200 by applying force through operation of propellers 505 and 506. In its simplest form, bumper 504 simply allows device 500 to exhort a force against floating pool fountain and light device 200.

FIG. 27 shows location device 500 in contact with floating pool fountain and light device 200. Thereafter, control signals receive by antenna 502 and operative in the manner described below selectively energize propellers 505 and 506 alone or in combination to produce the desired force against device 200 and retrieve it or move it as desired. It will be apparent that this apparatus allows the user to maintain the desired limitations on positioning of floating pool fountain light device 200 in large pool environments as well as open bodies of water as desired.

Figure 28:
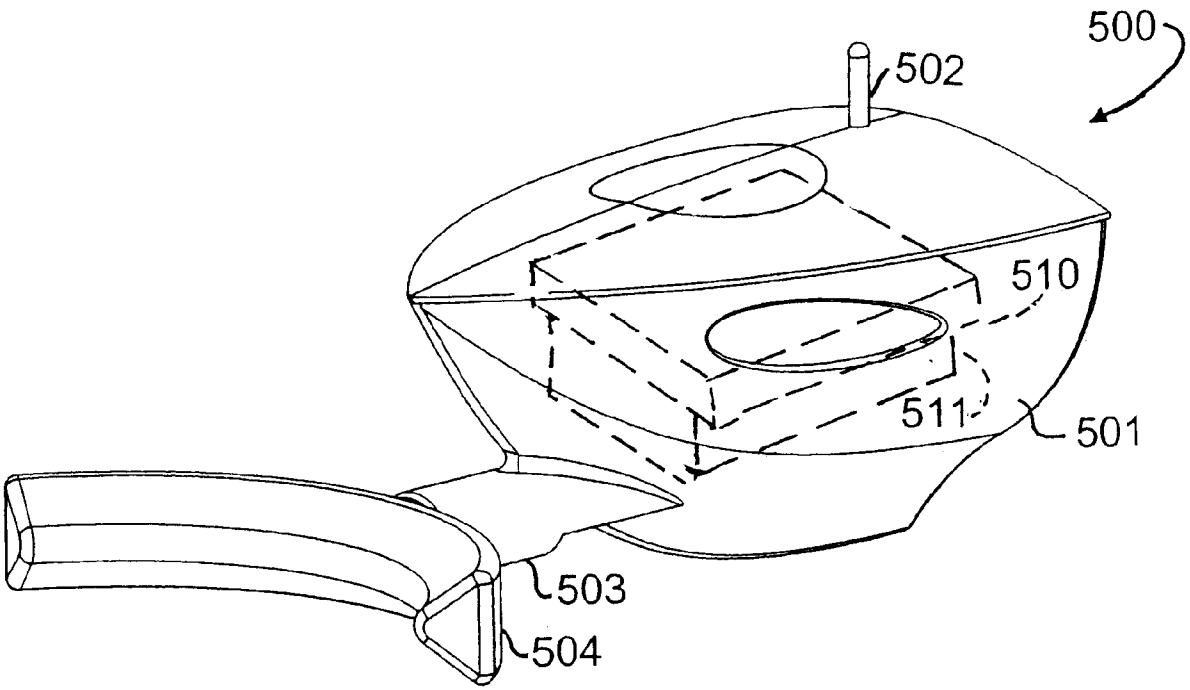
FIG. 28 sets forth a perspective view of the moving device of FIGS. 26 and 27.

FIG. 28 sets forth a perspective view of device 500 showing hull 501 supporting an antenna 502. Within hull 501, a control unit 510 set forth below in FIG. 30 in block diagram form is supported together with a battery 511. Battery 511 provides operative power for the propulsion system of device 500. A post 503 extends forwardly from hull 501 and supports a bumper or attachment mechanism 504.

Figure 29:
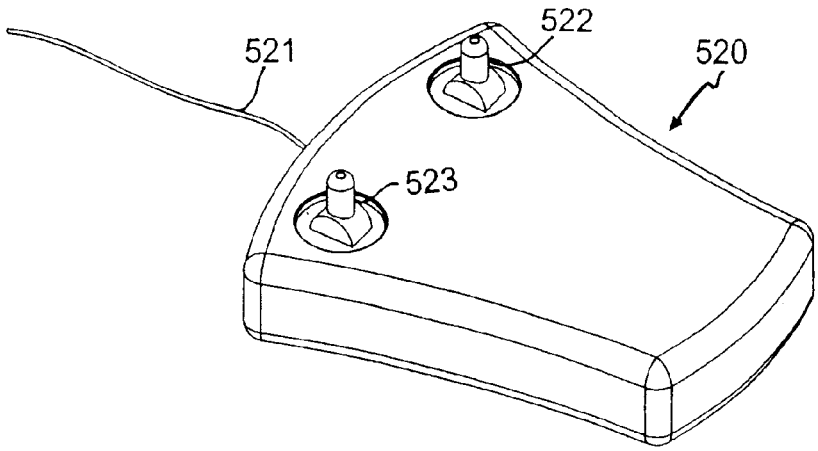
FIG. 29 sets forth a perspective view of the remote controller for the moving device of FIG. 28.
Figure 30:
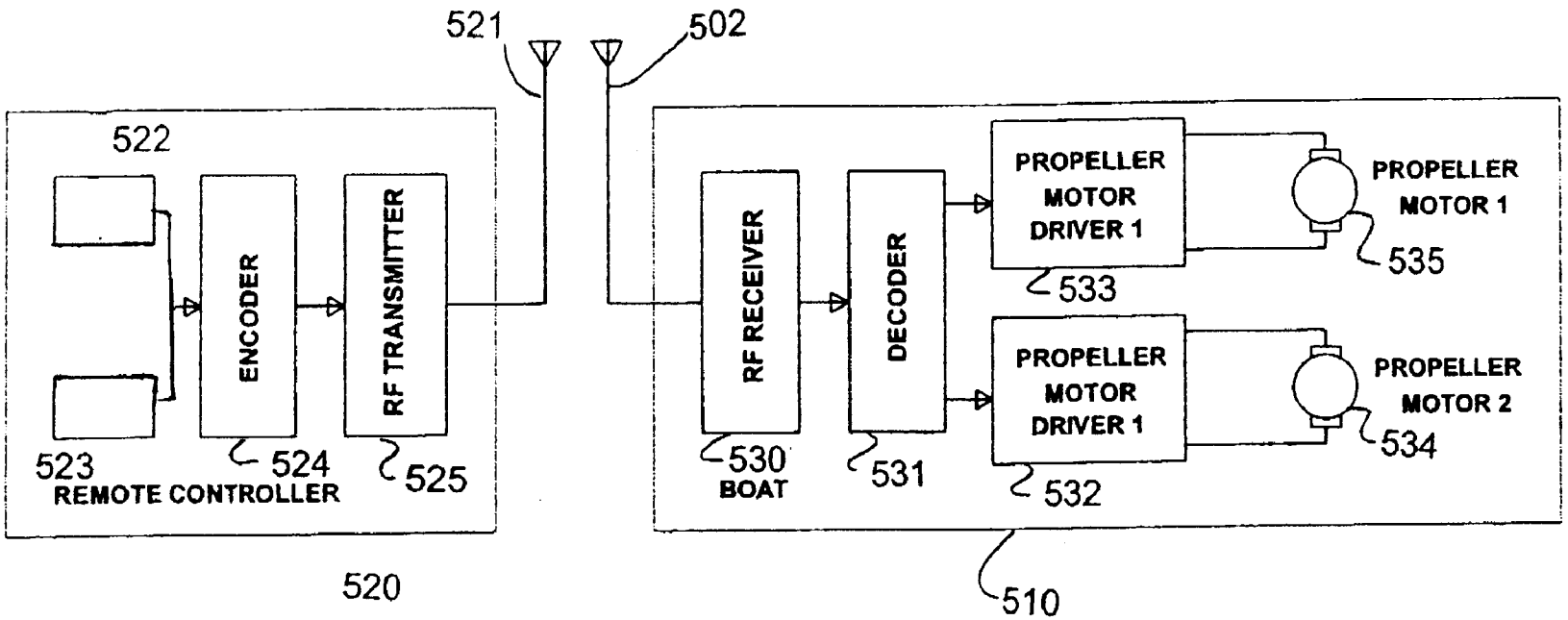
FIG. 30 sets forth a block diagram of the remote control apparatus operative upon and within the moving device shown in FIG. 29.

FIG. 29 sets forth a perspective view of a remote control unit 520 utilized in combination with control unit 510 (seen in FIG. 30) to control the operation of locating device 500. Remote control unit 520 operates in accordance with conventional fabrication technique as does control unit 510 and battery 511 (seen in FIG. 28). Thus, in essence, device 500 operates in the same manner as a remotely controlled miniature or toy boat to perform its maneuvering process. Accordingly, remote control unit 520 includes a remote control and radio frequency transmitter circuit as seen in FIG. 30 which provides control signals to antenna 521 for communication to antenna 502 of device 500 (seen in FIG. 28). As a matter of design choice, remote control unit 520 utilizes a pair of "joystick" switches 522 and 523 which are pressed forwardly and rearwardly to operate propellers 505 and 506 forwardly and rearwardly to maneuver location device 500.

FIG. 30 sets forth a block diagram of the remote control apparatus and its associated system for maneuvering and moving location device 500. As described above, a conventional remote control unit 520 includes a pair of control switches 522 and 523. The outputs of switches 522 and 523 are coupled to a conventional digital encoder 524 which in turn supplies corresponding control signals to a radio frequency transmitter 525. Transmitter 525 modulates the control signals upon a suitable carrier and applies it to a transmitting antenna 521.

Within control unit 510, antenna 502 receives the transmitted signals from antenna 521 and applies them to a radio frequency receiver 530. Within receiver 530, conventional receiver circuitry is operative to remove the modulated carrier from the received signal and to recover the digital control signals provided by remote control unit 520. The control signals are coupled to a decoder 531 which, in accordance with conventional fabrication techniques, operates to provide activation signals for a pair of propeller motor drivers 532 and 533. Propeller motor drivers 532 and 533 are operatively coupled to a pair of conventional propeller motors 534 and 535. The activation of either or both of propeller motors 534 and 535 in response to control signals correspondingly rotates propellers 505 and 506 to provide the desired thrust of location device 500 (seen in FIG. 27). In this manner, the cooperation of remote control unit 520 and control unit 510 allows the remote operation of location device 500.

Figure 31:
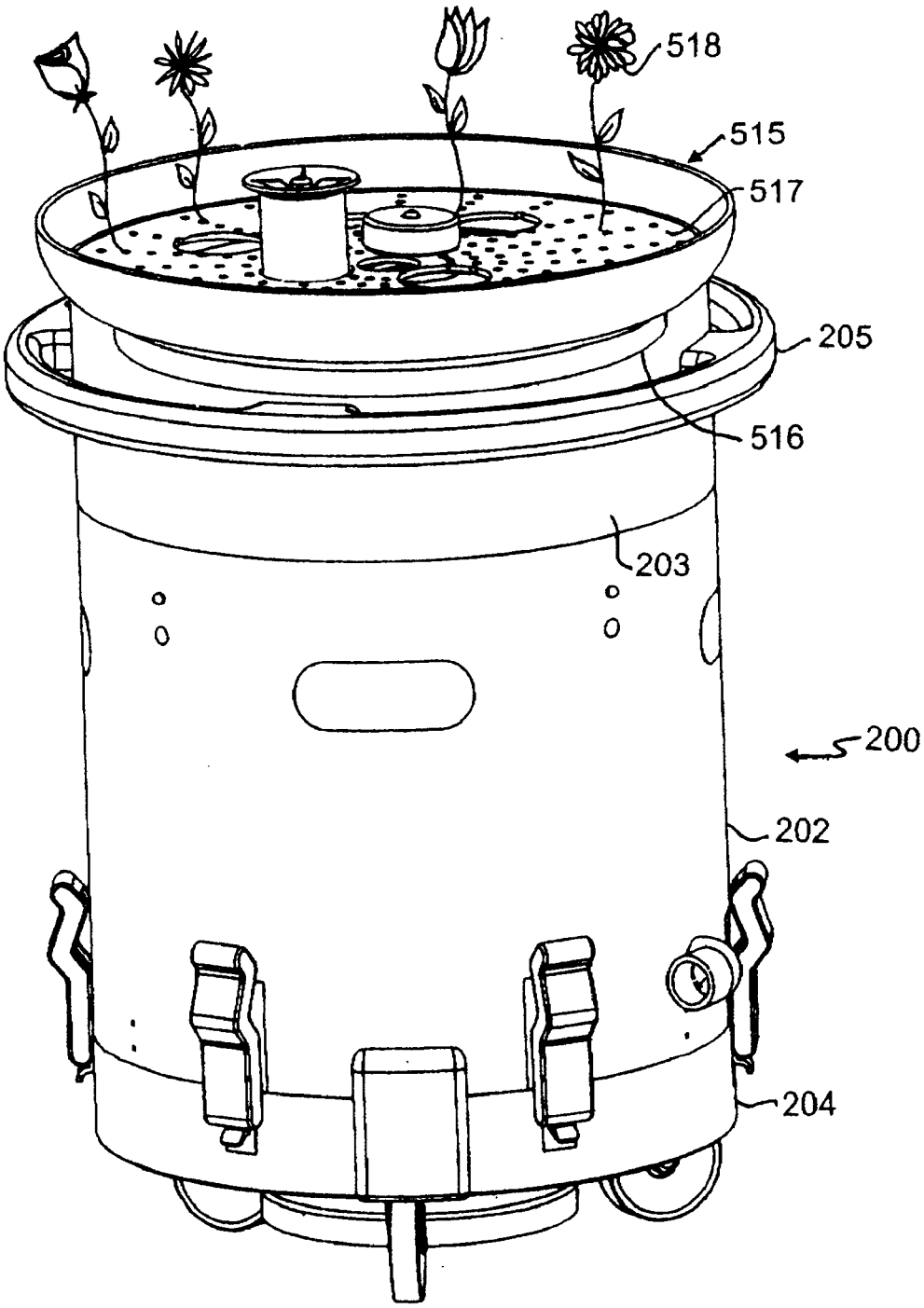
FIG. 31 sets forth a perspective view of the present invention floating pool fountain and light device together with a decorative accessory therefore.

FIG. 31 sets forth a perspective view of floating pool fountain and light device 200 having an accessory 515 thereon. As described above, device 200 includes an upper housing 203 having a bumper ring 205 together with a center housing 202 and a lower housing 204. Accessory 515 is received upon device 200 by a recess 516 and defines an upper surface 517. A plurality of decorative items 518 may be supported by surface 517 to further enhance the aesthetic appeal of the present invention device.

What has been shown is a novel floating pool fountain and light device which operates under remote control to provide varied pool fountain sprays and illumination thereof together with pool illumination by independently also remotely controlled apparatus. An automatic spacer device facilitates the positioning of the present invention floating pool fountain and light device in an automatic fashion away from the edges of the pool environment. In addition, manual positioning of the floating pool fountain and light device at the remote control of the user is facilitated by a small boat-like location device which may be used to thrust the floating pool fountain and light device in a desired direction.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in a pool of water, a floating pool fountain and light device comprising:

a buoyant housing having an upper surface and interior cavity;

a plurality of fountain nozzles directed generally upwardly;

a plurality of light-sources projecting generally upwardly;

a first battery-powered pump producing a first water flow coupled to said fountain nozzles for producing a generally upwardly directed spray;

a remote control unit producing control signals;

a second battery-powered pump producing a second water flow;

a rotation jet coupled to said second battery-powered pump producing a thrust tending to rotate said floating fountain and light device; and a controller supported by said housing receiving said control signals and selectively receiving said control signals and selectively activating said first battery-powered pump, said second battery-powered pump and said light sources in response to said control signals.

2. The floating pool fountain and light device set forth in claim 1 wherein said first battery powered pump further includes nozzle selection means responsive to said controller for directing said first water flow to a selected one or more of said fountain nozzles.

3. The floating pool fountain and light device set forth in claim 2 wherein said plurality of light sources produce differently colored light responsive to said control signals.

4. The floating pool fountain and light device set forth in claim 1 further including a plurality of pool illumination sources responsive to said controller in said housing for directing light into surrounding pool water.

5. The floating pool fountain and light device set forth in claim 4 wherein said pool illumination sources produce colored light.

6. The floating pool fountain and light device set forth in claim 5 wherein said colored light is responsive to said control signals.

7. The floating pool fountain and light device set forth in claim 2 wherein said nozzle selection means includes a multiple valve and valve actuator.

8. The floating pool fountain and light device set forth in claim 1 further including an automatic spacing mechanism having a plurality of directional water jets directed generally outwardly from said housing, a plurality of sensors for sensing proximity of said pool fountain and light device to a pool edge or object, and a plurality of water jet actuators each responsive to one of said sensors, said sensors, said actuators and said water jets cooperating to automatically maintain a distance between said floating pool fountain and light device and a pool edge or object.

9. The floating pool fountain and light device set forth in claim 2 further including an automatic spacing mechanism having a plurality of directional water jets directed generally outwardly from said housing, a plurality of sensors for sensing proximity of said pool fountain and light device to a pool edge or object, and a plurality of water jet actuators each responsive to one of said sensors, said sensors, said actuators and said water jets cooperating to automatically maintain a distance between said floating pool fountain and light device and a pool edge or object.

10. The floating pool fountain and light device set forth in claim 9 wherein said plurality of light sources produce differently controlled light.

11. The floating pool fountain and light device set forth in claim 10 further including a plurality of pool illumination sources responsive to said controller in said housing for directing light into surrounding pool water.

12. The floating pool fountain and light device set forth in claim 11 wherein said pool illumination sources produce colored light.

13. The floating pool fountain and light device set forth in claim 12 wherein said colored light is responsive to said control signals.

14. For use in a pool of water, a floating pool fountain and light device comprising:

a buoyant housing having an upper surface and interior cavity;

at least one generally upwardly directed battery-powered fountain producing fountain spray;

at least one light source directed to illuminate said fountain spray; and an automatic spacing mechanism having a plurality of directional water jets directed generally outwardly from said housing, a plurality of sensors for sensing proximity of said pool fountain and light device to a pool edge or object, and a plurality of water jet actuators each responsive to one of said sensors, said sensors, said actuators and said water jets cooperating to automatically maintain a distance between said floating pool fountain and light device and a pool edge or object.

15. The floating pool fountain and light device set forth in claim 1 further including a remotely controlled battery-powered boat having means for contacting said housing and for moving said floating pool fountain and light device within a pool.

16. The floating pool fountain and light device set forth in claim 1 further including:

an anchor;

an anchor line having one end secured to said anchor; and a motor-driven retractor responsive to said control signals and secured to said housing for retracting said anchor line to raise said anchor and for extending said anchor line to lower said anchor.

17. The floating pool fountain and light device set forth in claim 14 further including a remotely controlled battery-powered boat having means for contacting said housing and for moving said floating pool fountain and light device within a pool.

18. The floating pool fountain and light device set forth in claim 14 further including:

an anchor;

an anchor line having one end secured to said anchor; and a motor-driven retractor responsive to said control signals and secured to said housing for retracting said anchor line to raise said anchor and for extending said anchor line to lower said anchor.

19. The floating pool fountain and light device set forth in claim 1 wherein said first battery-powered pump is a variable speed pump for controlling fountain spray height.

20. The floating pool fountain and light device set forth in claim 19 wherein said second battery-powered pump is a variable speed pump for controlling the rotation speed of said thrust.

21. The floating pool fountain and light device set forth in claim 1 wherein said housing defines a center housing, an upper housing and a lower housing and wherein said lower housing includes a lower plate supporting the remaining components of said floating pool fountain and light device.

22. The floating pool fountain and light device set forth in claim 1 wherein said upper surface supports a battery charger plug and cap.

23. The floating pool fountain and light device set forth in claim 21 wherein said lower plate includes a plurality of extending casters.

24. The floating pool fountain and light device set forth in claim 1 further including an automatic spacing mechanism having a plurality of rotatable impellers producing water thrust directed generally outwardly from said housing, a plurality of sensors for sensing proximity of said pool fountain and light device to a pool edge or object, said impellers each responsive to one of said sensors, said sensors and said impellers cooperating to automatically maintain a distance between said floating pool fountain and light device and a pool edge or object.

25. The floating pool fountain and light device set forth in claim 3 wherein said controller includes default settings for each function responsive to said control signals which in the absence of said control signals establish a predetermined point of operation for all functions.

26. The floating pool fountain and light device set forth in claim 1 further including an accessory received upon said housing upper surface having a plurality of decorative items thereon.

* * * * *